US010504538B2

(12) United States Patent
Bullough

(10) Patent No.: US 10,504,538 B2
(45) Date of Patent: Dec. 10, 2019

(54) NOISE REDUCTION BY APPLICATION OF TWO THRESHOLDS IN EACH FREQUENCY BAND IN AUDIO SIGNALS

(71) Applicant: Sorenson IP Holdings, LLC, Salt Lake City, UT (US)

(72) Inventor: Jeffrey Bullough, South Jordan, UT (US)

(73) Assignee: SORENSON IP HOLDINGS, LLC, Salt Lake, UT (US)

( * ) Notice: Subject to any disclaimer, the term of this patent is extended or adjusted under 35 U.S.C. 154(b) by 119 days.

(21) Appl. No.: 15/611,499

(22) Filed: Jun. 1, 2017

(65) Prior Publication Data

US 2018/0350382 A1 Dec. 6, 2018

(51) Int. Cl.

| | |
|---|---|
| ***G10L 21/0208*** | (2013.01) |
| ***G10L 21/02*** | (2013.01) |
| ***G10L 19/012*** | (2013.01) |
| ***G10L 21/0232*** | (2013.01) |
| ***G10L 25/84*** | (2013.01) |
| *G10L 19/02* | (2013.01) |

(52) U.S. Cl.

CPC ..... *G10L 21/0232* (2013.01); *G10L 25/84* (2013.01); *G10L 19/012* (2013.01); *G10L 19/0204* (2013.01); *G10L 21/0208* (2013.01)

(58) Field of Classification Search

CPC ..... G10L 21/0208; G10L 19/0204; G10L 19/012

USPC ..... 704/226, 233; 381/57; 375/240

See application file for complete search history.

(56) References Cited

U.S. PATENT DOCUMENTS

| | | | | |
|---|---|---|---|---|
| 5,668,927 | A | 9/1997 | Chan et al. | |
| 5,806,025 | A | 9/1998 | Vis et al. | |
| 5,822,370 | A * | 10/1998 | Graupe | G10L 19/0204 375/240 |
| 5,999,954 | A | 12/1999 | Ludwig et al. | |
| 6,032,114 | A | 2/2000 | Chan | |
| 6,144,937 | A | 11/2000 | Ali | |
| 6,718,301 | B1 | 4/2004 | Woods | |

(Continued)

FOREIGN PATENT DOCUMENTS

| | | |
|---|---|---|
| CA | 2549744 A1 | 12/2006 |
| EP | 2151822 A1 | 10/2010 |

(Continued)

*Primary Examiner* — Farzad Kazeminezhad
(74) *Attorney, Agent, or Firm* — Maschoff Brennan

(57) ABSTRACT

A computer-implemented method to reduce noise in an audio signal is disclosed. The method may include obtaining an audio signal and separating the audio signal into frequency components in each of multiple frequency bands. The method may include obtaining a first magnitude threshold for a first frequency band of the plurality of frequency bands. The method may include calculating a first envelope of first frequency components in the first frequency band during a first time frame and a second envelope of the first frequency components during a second time frame after the first time frame. The method may include, in response to a difference between the first envelope and the second envelope of the first frequency band being less than the first magnitude threshold, attenuating the first frequency components. The method may include combining the frequency components, including the attenuated first frequency components, to produce an output audio signal.

18 Claims, 15 Drawing Sheets

(56) References Cited

U.S. PATENT DOCUMENTS

| | | | | |
|---|---|---|---|---|
| 6,898,566 | B1 | 5/2005 | Benyassine et al. | |
| 2005/0240401 | A1* | 10/2005 | Ebenezer | G10L 21/0208 704/226 |
| 2012/0057711 | A1* | 3/2012 | Makino | G10L 21/0208 381/57 |
| 2013/0282373 | A1 | 10/2013 | Visser et al. | |
| 2014/0316774 | A1* | 10/2014 | Wang | G10L 19/012 704/226 |
| 2015/0106088 | A1* | 4/2015 | Jarvinen | G10L 21/0208 704/233 |

FOREIGN PATENT DOCUMENTS

| | | | |
|---|---|---|---|
| EP | 2419900 | A1 | 2/2012 |
| WO | 2001052242 | A1 | 7/2001 |
| WO | 2014056328 | A1 | 4/2014 |

* cited by examiner

NOISE REDUCTION BY APPLICATION OF TWO THRESHOLDS IN EACH FREQUENCY BAND IN AUDIO SIGNALS

FIELD

The embodiments discussed herein are related to detecting and reducing noise.

BACKGROUND

Modern telecommunication services provide features to assist those who are deaf or hearing-impaired. One such feature is a text captioned telephone system for the hearing-impaired. A text captioned telephone system may include a telecommunication intermediary service that is intended to permit a hearing-impaired user to utilize a normal telephone network.

The subject matter claimed herein is not limited to embodiments that solve any disadvantages or that operate only in environments such as those described above. Rather, this background is only provided to illustrate one example technology area where some embodiments described herein may be practiced.

SUMMARY

A computer-implemented method to reduce noise in an audio signal is disclosed. The method may include obtaining an audio signal and separating the audio signal into frequency components in each of multiple frequency bands. The method may further include obtaining a first magnitude threshold for a first frequency band of the plurality of frequency bands. The method may also include calculating a first envelope of first frequency components in the first frequency band during a first time frame and a second envelope of the first frequency components during a second time frame after the first time frame. In response to a difference between the first envelope and the second envelope of the first frequency band being less than the first magnitude threshold, the first frequency components may be attenuated. The method may also include combining the frequency components, including the attenuated first frequency components, to produce an output audio signal.

BRIEF DESCRIPTION OF THE DRAWINGS

Example embodiments will be described and explained with additional specificity and detail through the use of the accompanying drawings in which.

DESCRIPTION OF EMBODIMENTS

Figure 1:
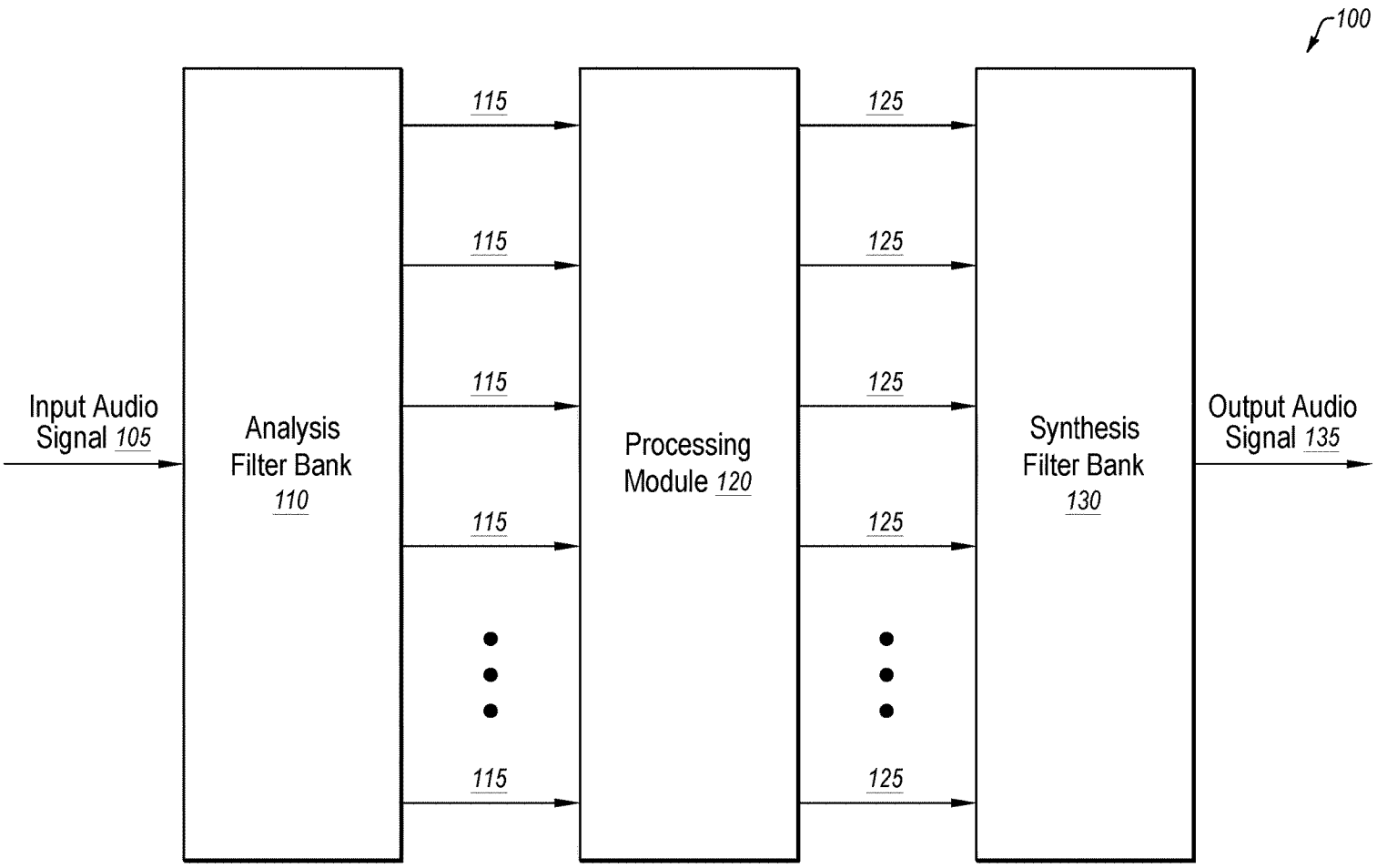
FIG. 1 illustrates an example frequency band processing system.

Some embodiments in this disclosure relate to a method and/or system that may reduce noise in an audio signal. In these and other embodiments, noise may include an unwanted portion of a signal that may degrade an original message that is communicated or transmitted. For example, a signal may be sent from a first device to a second device. After the signal has been transmitted from the first device, the signal sent from the first device may be unintentionally altered prior to the second device receiving the signal. The unintentional altering may be referred to as noise.

In some embodiments, some types of noise may include thermal noise, shot noise, flicker noise, and burst noise. Sources of noise may include electronic components between the first device and the second device, including the first device and the second device; background sound surrounding the source speaker; quantization noise from an analog to digital converter; and radiated noise from radio frequency interference; among other sources.

Some embodiments in this disclosure describe a device that may be configured to reduce noise in an audio signal. For example, the device may separate the audio signal into frequency components in multiple frequency bands. Multiple envelopes of the frequency components in each of the frequency bands may be calculated to determine if there is an intended audio signal in each frequency band. In these and other embodiments, the frequency components in frequency bands determined to not include an intended audio signal may be attenuated. For example, the frequency components in the frequency bands without an intended audio signal may be attenuated by a percentage amount or by an amount based on the amount of noise in the frequency band.

In some embodiments, the presence of an intended audio signal may be determined for each of the multiple frequency bands individually. For example, in some embodiments, the presence of an intended audio signal may be determined when the difference between a first envelope of the frequency components during a first time frame and a second envelope of the frequency components during a second time frame after the first time frame is more than a magnitude threshold. Alternatively or additionally, the presence of an intended audio signal may be determined using a first envelope of the frequency components during a first duration of time and a second envelope of the frequency components during a second duration of time that overlaps the first duration of time.

In short, in some embodiments, the device may be configured so that noise in an audio signal may be attenuated without attenuating frequency components of the audio signal that include the intended audio signal. As a result, the device may be configured to increase the signal-to-noise ratio of the audio signal, which may increase the understandability of the intended audio signal. Increasing the signal-to-noise ratio may also reduce situations where the audio signal becomes unpleasant or unintelligible because of noise in the audio signal.

In some embodiments, the systems and/or methods described in this disclosure may thus help to process an audio signal and may help to improve a signal-to-noise ratio of the audio signal. Thus, the systems and/or methods described in this disclosure may provide at least a technical solution to a technical problem associated with the design of user devices in the technology of telecommunications.

FIG. 1 illustrates an example frequency band processing system 100. The processing system 100 may be arranged in accordance with at least one embodiment described in the present disclosure. The processing system 100 may include an analysis filter bank 110, a processing module 120, and a synthesis filter bank 130, all of which may be communicatively coupled.

The analysis filter bank 110 and the synthesis filter bank 130 may each include an analog filter bank, a digital filter bank, a Fast Fourier Transform-based filter bank, a wavelet based filter bank, and/or other filter systems. In some embodiments, the analysis filter bank 110 and the synthesis filter bank 130 may include different types of filters. For example, in some embodiments, the analysis filter bank 110 may include an analog filter bank and the synthesis filter bank 130 may include a digital filter bank.

The analysis filter bank 110 may be configured to separate an input audio signal 105 into different frequency bands 115. In some embodiments, the input audio signal 105 may include noise. The noise may be a result of an analog-to-digital converter between a source of the input audio signal 105 and the analysis filter bank 110. Additionally or alternatively, the noise may be the result of background sound during the creation of the input audio signal 105. Alternatively or additionally, the noise in the input audio signal 105 may include other types of noise.

In these and other embodiments, the analysis filter bank 110 may separate the input audio signal 105 into any number of frequency bands 115. In some embodiments, the analysis filter bank 110 may separate the input audio signal 105 into frequency bands within the range normally audible to humans. For example, in these and other embodiments, the audio signal may be separated in frequency bands from the range of approximately 0.02 kilohertz (kHz) to approximately 20 kHz. In these and other embodiments, parts of the audio signal outside of this range may be ignored. For example, audio in the frequency range from 30 kHz to 40 kHz may not be analyzed as the frequency range may not be heard by humans. In these and other embodiments, the frequency bands 115 may include a subset of frequencies in the range of human hearing. For example, in some embodiments, the frequency bands 115 may include frequencies from 0 kHz to 5 kHz. Alternatively or additionally, in some embodiments, the analysis filter bank 110 may ignore frequencies of the input audio signal 105 outside of the range of normal human speech. For example, in some embodiments, frequencies outside the range of 0.08 kHz to 1 kHz may be ignored. Alternatively or additionally, in some embodiments, the frequency bands 115 may include frequencies from 0.3 kHz to 1 kHz.

In some embodiments, increasing the number of frequency bands 115 may increase the resolution of the detection and reduction of noise in the input audio signal 105. For example, separating the input audio signal 105 into a greater number of frequency bands 115 may allow a greater proportion of the input audio signal 105 to pass through the processing module 120 without being attenuated. In some embodiments, the analysis filter bank 110 may separate the input audio signal 105 into frequency bands having approximately the same bandwidth of frequency. For example, in some embodiments, each of the frequency bands may include 0.1 kHz of frequency, 0.5 kHz of frequency, 1 kHz of frequency, or any other bandwidth of frequency.

Alternatively, in some embodiments, the audio signal may be separated into frequency bands where each frequency band includes a different bandwidth. For example, lower or higher frequency bands may include more frequency bandwidth. For example, the frequency bands may include frequency bandwidths in a logarithmic or other pattern. Alternatively, in some embodiments, one or more of the frequency bands may include different frequency bandwidths while other frequency bands include the same frequency bandwidths. For example, the lowest frequency bandwidth and the highest frequency bandwidth may include 0.5 kHz of frequency while the frequency bands between these two bands may each include 0.1 kHz of frequency. Alternatively or additionally, in some embodiments, the analysis filter bank 110 may separate the input audio signal 105 into frequency bands based on octaves of the input audio signal 105. In these and other embodiments, an octave may represent a doubling of frequency. For example, a first octave may include a frequency band from 0.02 kHz to 0.04 kHz. A second octave may include a frequency band from 0.04 kHz to 0.08 kHz. A third octave may include a frequency band from 0.08 kHz to 0.16 kHz.

The processing module 120 may be configured to reduce noise in frequency components of the frequency bands 115. In some embodiments, the processing module 120 may determine whether any of the frequency bands include an intended audio signal. In these and other embodiments, the processing module 120 may determine whether any of the frequency bands include an intended audio signal based on a comparison of envelopes of frequency components in each of the multiple frequency bands. In these and other embodiments, envelopes of frequency components may be compared individually with each other and with a threshold. For example, in some embodiments, envelopes of frequency components for the first frequency band may be compared with a first threshold. Separately, envelopes of frequency components for the second frequency band may be compared with a second threshold. In these and other embodiments, the first threshold and the second threshold may be different thresholds. Thus, in these and other embodiments, envelopes of one frequency band may not be compared with envelopes of another frequency band. For example, envelopes of frequency components for a first frequency band may not be compared with envelopes of frequency components for a second frequency band. Alternatively or additionally, differences between envelopes of one frequency band may not be compared with thresholds for other frequency bands.

In some embodiments of a first method, the processing module 120 may be configured to calculate a first envelope of the frequency components in a frequency band by calculating a root mean square (RMS) average magnitude of the frequency components in the frequency band during a first time frame. In these and other embodiments, the processing module 120 may also be configured to calculate a second envelope of the frequency components by calculating an RMS average magnitude of the frequency components during a second time frame. In some embodiments, a different calculation may be used to determine the first envelope and the second envelope. In some embodiments, the processing module 120 may use an envelope detector with a low pass filter to track the average power of the frequency components in the frequency band over the first time frame and over the second time frame.

In some embodiments, the second time frame may be after the first time frame. For example, the first time frame may be from 0 milliseconds (ms) to 50 ms of the input audio signal 105 and the second time frame may be from 100 ms to 150 ms.

In some embodiments, the processing module 120 may compare the first envelope of the frequency components with the second envelope of the frequency components. If the difference between the first envelope and the second envelope is less than a first magnitude threshold, the processing module 120 may determine that the frequency band does not include an intended audio signal.

In some embodiments of a second method, the processing module 120 may be configured to calculate a first signal envelope for first frequency components in the first frequency band for a first duration of time. A second signal envelope may be calculated for first frequency components during a second duration of time that is longer than the first duration of time. In some embodiments, the second duration of time may be a duration of time 2 times longer than the first duration of time, 5 times longer than the first duration of time, 10 times longer than the first duration of time, or any amount of time longer than the first duration of time. In some embodiments, the second duration of time may overlap the first duration of time. In some embodiments, the first signal envelope may have a magnitude greater than the second signal envelope when the frequency components include an intended audio signal, such as speech. For example, in some embodiments, the first duration of time may be a time period from 50 ms to 150 ms of the input audio signal 105 and the second duration of time may be a time period from 50 ms to 1,050 ms of the input audio signal 105.

The processing module 120 may be configured to calculate a noise ratio from the first signal envelope and the second signal envelope. In some embodiments, the first signal envelope and the second signal envelope may be measured in decibels. In these and other embodiments, the noise ratio may be calculated as a difference between the second signal envelope and the first signal envelope. Alternatively or additionally, in some embodiments, the first signal envelope or the second signal envelope may not be measured in decibels. In these and other embodiments, the noise ratio may be calculated as a ratio of the first signal envelope to the noise. In some embodiments, the second signal envelope may approximately be or may be noise in the frequency band. The processing module 120 may compare the noise ratio with a noise threshold. If the noise ratio is less than the noise threshold, the processing module 120 may determine that the frequency components in the frequency band do not include an intended audio signal.

In some embodiments, the presence of an intended audio signal in a frequency band may be determined by analyzing the rate at which envelopes of the frequency components change in frequency bands. In these and other embodiments, an envelope detector in each frequency band may look at multiple frames of the frequency components. A frame of the frequency components may be a duration of time less than the durations of time used to calculate noise ratios. For example, in some embodiments, the first duration of time may be 200 ms, the second duration of time may be 1000 ms, and a frame of the frequency components may be 100 ms. Alternatively, in some embodiments, the frames of the frequency components may have the same duration as the first duration of time or the second duration of time. In some embodiments, multiple frames may be analyzed to determine if a frequency band includes an intended audio signal. For example, in some embodiments, the envelope detector may look at every frame, every other frame, every third frame, every fourth frame, or any other number of frames. For example, if the frame length is 50 ms and the second duration of time is 500 ms, eleven frames may be analyzed.

In some embodiments, the magnitude thresholds and/or noise thresholds for each of the frequency bands may be based on characteristics of human speech in the associated frequency band. For example, a first magnitude threshold may be based on characteristics of human speech in a first frequency band and a second magnitude threshold may be based on characteristics of human speech in a second frequency band. As a result, in some embodiments, each of the magnitude thresholds may be different for different frequency bands and the noise thresholds may be different for different frequency bands.

Characteristics of human speech may include phonemes of human speech in the particular frequency band. In these and other embodiments, phonemes of human speech may differ for different languages. For example, phonemes in a particular frequency band for French may differ from phonemes in the particular frequency band for Japanese or English. In these and other embodiments, the magnitude thresholds and the noise thresholds may be determined using phonemes analysis of human speech. For example, human speech patterns may contain inflections in pitch, tone, and magnitude during the course of verbal communication. Human speech patterns may include different magnitudes and durations in different frequency bands. For example, speech in a first frequency band may typically have a first magnitude and a first duration while speech in a second frequency band may typically have a second magnitude and a second duration. A first magnitude threshold for the first frequency band may be based on the first magnitude and the first duration typical to the first frequency band. A second magnitude threshold for the second frequency band may be based on the second magnitude and the second duration typical to the second frequency band. Thus, the first magnitude threshold for the first frequency band may be different from the second magnitude threshold for the second frequency band. For example, during speech, the magnitude and frequency range for a human voice may vary over the course of 100 milliseconds or 200 milliseconds. However, noise present in an audio signal may not vary in terms of magnitude or frequency over a duration of time of 100 milliseconds or 200 milliseconds. For example, an envelope of the frequency components of an audio signal without an audio signal component may not change often. As a result, a difference between two envelopes of the frequency components may not be greater than a magnitude threshold. Alternatively, an audio signal component of an audio signal in frequency components in a frequency band may increase the noise ratio to be above a noise threshold.

Alternatively or additionally, in some embodiments, the magnitude thresholds and the noise thresholds may also be based on one or more amplifications in the analysis filter bank 110, the processing module 120, and/or in the processing system 100. In some embodiments, the magnitude thresholds may also be based on the duration of the first time frame and the second time frame. In these and other embodiments, the magnitude thresholds may also be based on how often the envelopes are calculated. In some embodiments, the noise threshold may be based on a noise level of a typical conversation in a frequency band.

The processing module 120 may be configured to attenuate the frequency components of the frequency bands that are determined to not include an intended audio signal using either the first method, the second method, or another method. For example, in some embodiments, the processing module 120 may attenuate the frequency components of a frequency band from a first time frame to a second time frame, where the frequency components are determined to not include intended audio signal between the first time frame and the second time frame. In these and other embodiments, the processing module 120 may not attenuate the frequency components of the frequency band from a third point in time to a fourth point in time, where the frequency components are determined to include intended audio signal components. Frequency components in frequency bands may be attenuated between some points in time and may not be attenuated between other points in time. Alternatively or additionally, frequency components in some frequency bands may not be attenuated and frequency components in some frequency bands may be attenuated between each point in time.

In some embodiments, the processing module 120 may attenuate frequency components in a frequency band without intended audio signal components by a fixed percentage amount of the frequency components. For example, in some embodiments, the frequency components of a frequency band without intended audio signal components may be attenuated by 1, 2, 5, 10, 15, 20, 25, 30, or 50 percent or any other percentage of the frequency components. Alternatively or additionally, in some embodiments, the frequency components of frequency bands without intended audio signal components may be attenuated by an amount based on the signal-to-noise ratio in the frequency components of the frequency bands. The signal-to-noise ratio in the frequency components of a frequency band may be determined based on a difference between the magnitude of a first envelope of the frequency components in the frequency band and the magnitude of a second envelope of the frequency components in the frequency band. If the signal-to-noise ratio is below a first threshold, the frequency components may be determined to not include an intended audio signal. In these and other embodiments, the frequency components may be noise. If the signal-to-noise ratio is above a second threshold, the frequency components may be determined to include an intended audio signal. For example, if the signal-to-noise ratio is below the first threshold, the frequency components may be attenuated by a fixed percentage amount. If the signal-to-noise ratio is above the second threshold, the frequency components may not be attenuated. If the signal-to-noise ratio is between the first threshold and the second threshold, the amount of attenuation may be determined by interpolating the signal-to-noise ratio between the first threshold and the second threshold.

In some embodiments, the processing module 120 may be configured to process a frame of input audio signal 105. For example, the processing module 120 may be configured to process 20 ms, 50 ms, 100 ms, 200 ms, or any other duration of time of the input audio signal 105 at a time. In some embodiments, the processing module 120 may be configured to attenuate frequency bands 115 that are determined to not include intended audio signal components and to not attenuate frequency bands 115 that are determined to include intended audio signal components. In these and other embodiments, the processing module 120 may provide processed frequency bands 125 to the synthesis filter bank 130. In these and other embodiments, a particular processed frequency band 125 may be unchanged from the associated frequency band 115. For example, if a particular frequency band 115 is determined to include intended audio signal components, the associated processed frequency band 125 may be unchanged from the particular frequency band 115. In these and other embodiments, at different points in time, none, some, or all of the frequency bands 115 may be processed to produce different processed frequency bands 125.

In some embodiments, the synthesis filter bank 130 may be configured to combine each processed frequency band 125, including the attenuated frequency bands, into an output audio signal 135.

An example of reducing noise in an audio signal is now provided. An input audio signal 105 may be obtained by the analysis filter bank 110. For example, in some embodiments, the input audio signal 105 may be at least partially obtained during a communication session with another device. Alternatively or additionally, in some embodiments, the input audio signal 105 may be at least partially obtained from a microphone and an analog-to-digital converter communicatively coupled with the analysis filter bank 110. Alternatively or additionally, in some embodiments, the input audio signal 105 may be at least partially obtained from a digitally stored file, a file stored in an analog format, or any other location.

The analysis filter bank 110 may be configured to separate the input audio signal 105 into ten frequency bands 115. The frequency bands 115 may be from 0 to 0.5 kHz, from 0.5 to 1 kHz, from 1 to 1.5 kHz, from 1.5 to 2 kHz, from 2 to 2.5 kHz, from 2.5 to 3 kHz, from 3 to 3.5 kHz, from 3.5 to 4 kHz, from 4 to 4.5 kHz, and from 4.5 to 5 kHz. Alternatively, the input audio signal 105 may be separated into other frequency bands 115.

The processing module 120 may be configured to determine whether each frequency band 115 from the ten frequency bands 115 include intended audio signal components. The processing module 120 may be configured to determine whether a frequency band 115 includes intended audio signal components by calculating multiple envelopes for frequency components in the frequency band 115. Using the first method, the processing module 120 may be configured to determine if a difference between an envelope for a first time frame and an envelope for a second time frame is less than a magnitude threshold. If the difference is less than the magnitude threshold, the frequency band 115 may be determined to not include intended audio signal components. Alternatively, using the second method, the processing module 120 may be configured to calculate a signal-to-noise ratio based on an envelope for a first duration of time and an envelope for a second duration of time. If the signal-to-noise ratio is less than a noise threshold, the frequency band 115 may be determined to not include intended audio signal components.

For each frequency band 115 determined to not include intended audio signal components, the processing module 120 may be configured to attenuate the frequency components of the frequency band 115 during the duration of time the frequency band 115 is determined to not include intended audio signal components. For example, the frequency band 115 from 1 kHz to 1.5 kHz may be determined to not include intended audio signal components from 12.2 seconds to 12.9 seconds of the input audio signal 105. The frequency band 115 may be attenuated from 12.2 seconds to 12.9 seconds. The frequency band 115 from 2.5 kHz to 3 kHz may be determined to not include intended audio signal components from 4.3 seconds to 5.7 seconds and from 12.6 seconds to 13.8 seconds. The frequency band 115 may be attenuated from 4.3 seconds to 5.7 seconds and from 12.6 seconds to 13.8 seconds. Other frequency bands 115 may not include intended audio signal components during different durations of time, may not include intended audio signal components during overlapping durations of time, or may include intended audio signal components.

The processing module 120 may be configured to attenuate the frequency components in the frequency bands 115 that do not include intended audio signal components by a fixed percentage. For example, the processing module 120 may attenuate the frequency components by 10%. Alternatively, the processing module 120 may be configured to attenuate the frequency components in the frequency bands 115 based on a signal-to-noise ratio in the frequency components. After attenuating the frequency components in the frequency bands 115 without intended audio signal components, the processing module 120 may be configured to provide the processed frequency bands 125 to the synthesis filter bank 130. The synthesis filter bank 130 may be configured to combine the frequency bands 125 to generate an output audio signal 135.

The output audio signal 135 may be output over a speaker, but noise level of the output audio signal 135 may be reduced. Modifications, additions, or omissions may be made to the processing system 100 without departing from the scope of the present disclosure.

Figure 2A:
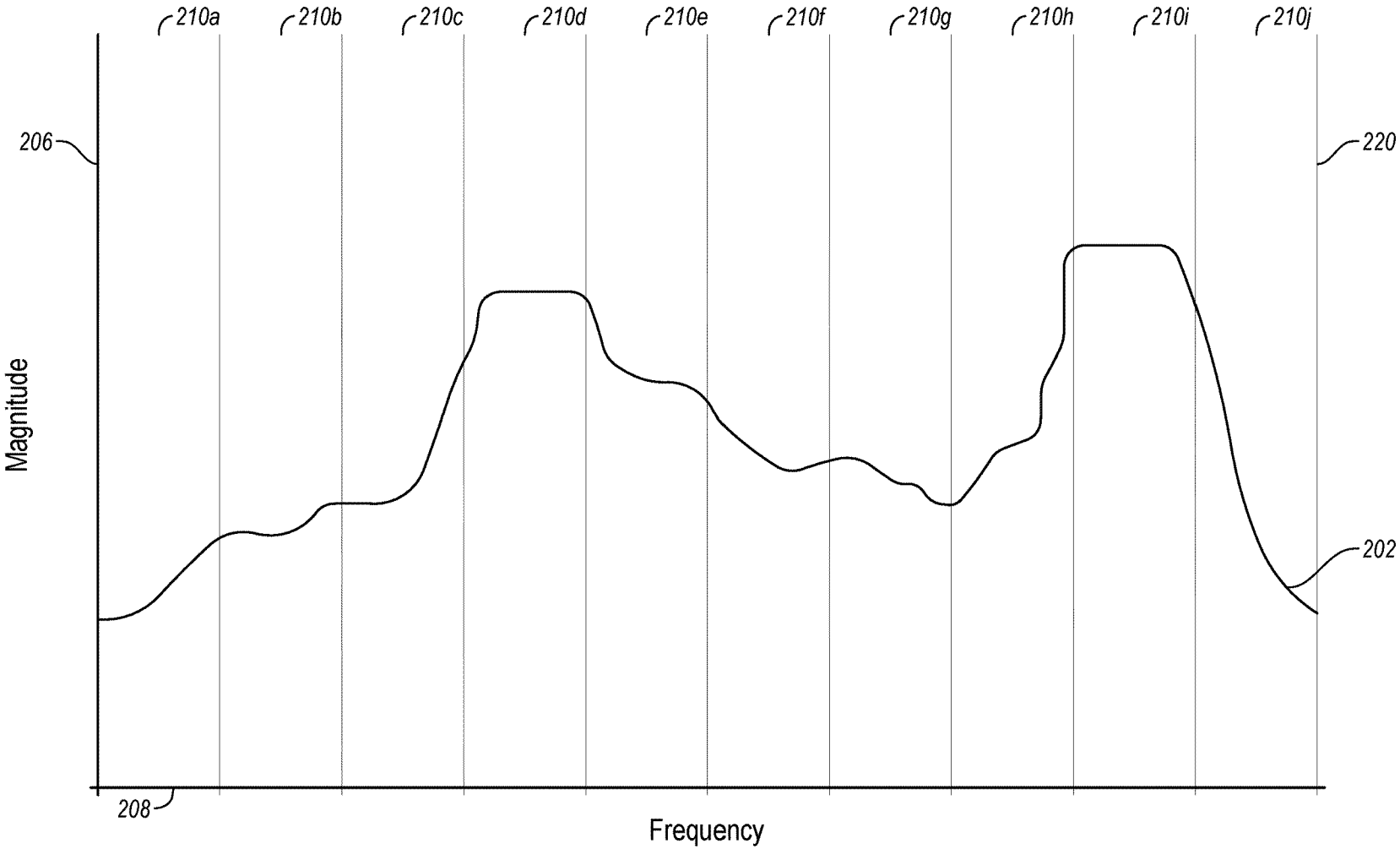
FIG. 2A is schematic diagrams illustrating an example audio signal separated into multiple frequency bands.
Figure 2B:
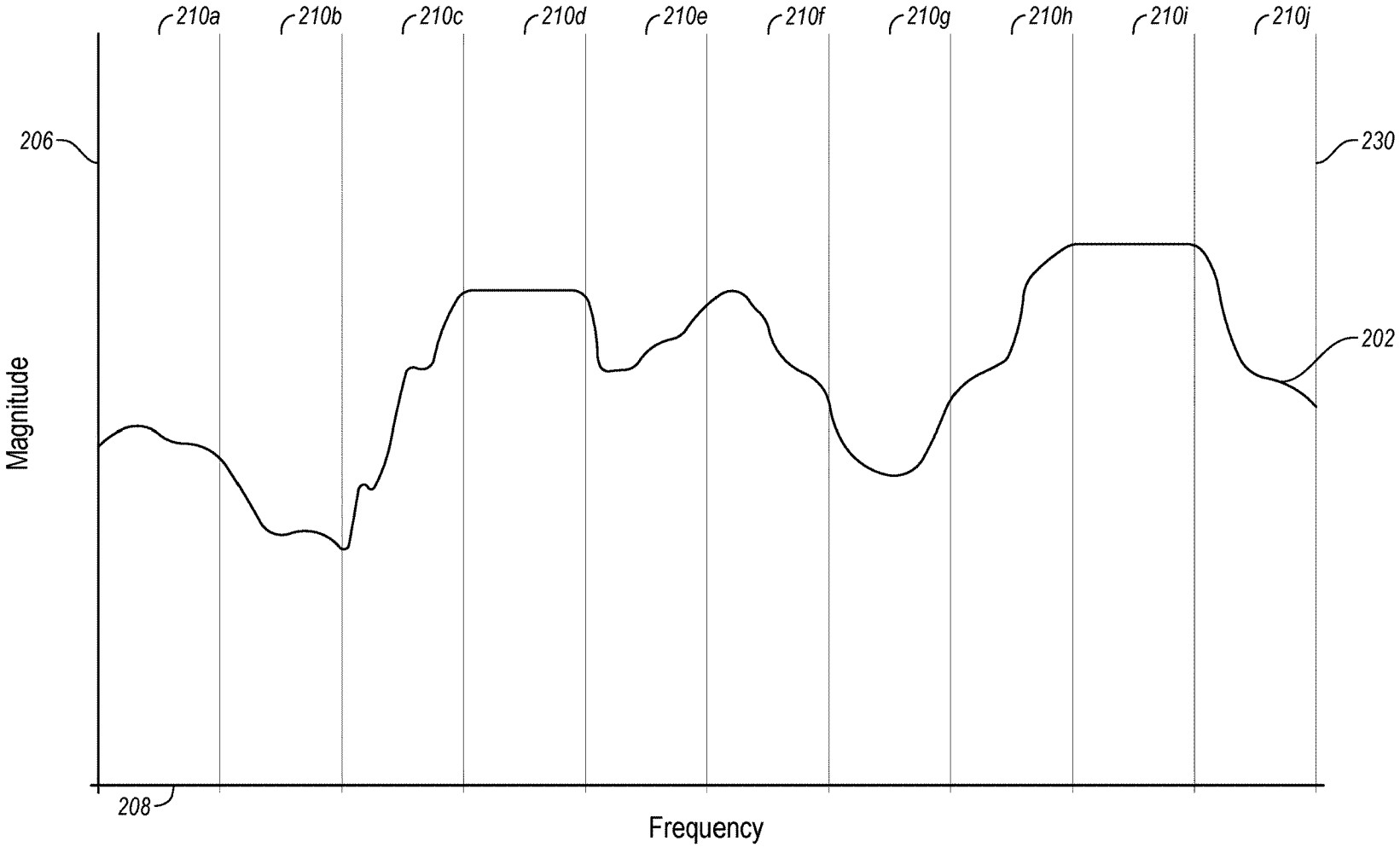
FIG. 2B is schematic diagrams illustrating another example audio signal separated into multiple frequency bands.
Figure 2C:
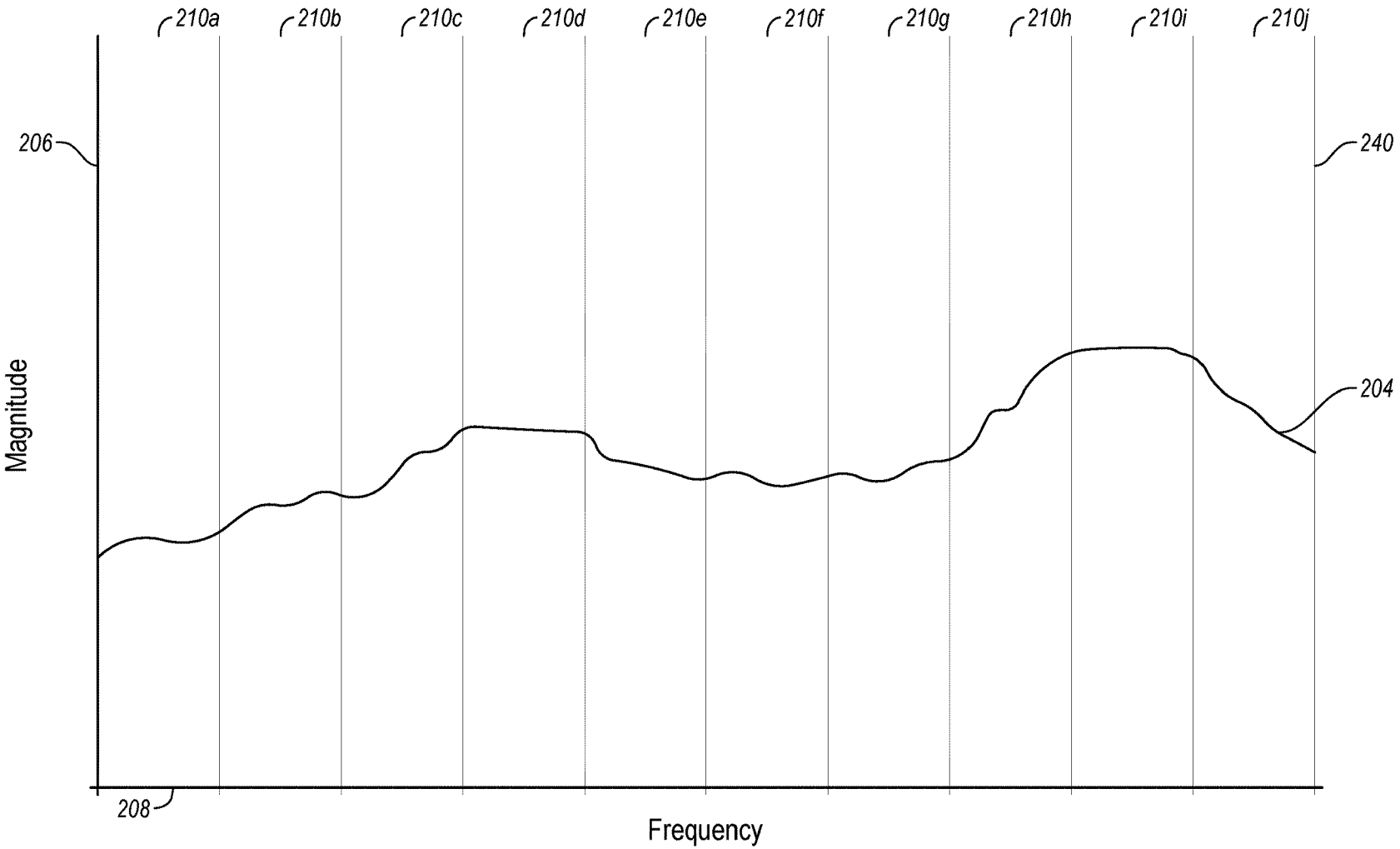
FIG. 2C is schematic diagrams illustrating another example audio signal separated into multiple frequency bands.

FIGS. 2A-2C illustrate schematic diagrams 220, 230, and 240 with an example audio signal 202 separated into multiple frequency bands. The schematic diagram 220 of FIG. 2*a* illustrates an audio signal 202 separated into ten frequency bands 210. The y-axis 206 of the schematic diagram 220 may represent a magnitude of the audio signal 202 at a particular frequency. In some embodiments, the magnitude of the audio signal 202 may be a normalized magnitude. The x-axis 208 of the schematic diagram 220 may represent a frequency of the audio signal 202. In some embodiments, the x-axis 208 may represent frequencies from 0 kHz to 20 kHz. Although depicted with ten frequency bands 210, in some embodiments, there may be more or fewer than ten frequency bands. Additionally, although the frequency bands 210 are depicted with approximately equal bandwidth of frequency, the frequency bands 210 may include different bandwidths of frequency. The schematic diagram 220 of FIG. 2*a* may represent the audio signal 202 at a first point in time. The schematic diagram 230 of FIG. 2*b* may represent the audio signal 202 at a second point in time. The schematic diagram 240 of FIG. 2*c* may represent an attenuated audio signal 204 after the audio signal 202 is attenuated.

In some embodiments, a processing environment, such as the processing system 100 of FIG. 1, may obtain the audio signal 202. In these and other embodiments, the audio signal 202 may be separated into ten frequency bands 210. The magnitude of the audio signal 202 may vary in each of the frequency bands 210. For example, as depicted in FIG. 2*a*, the magnitude of the audio signal 202 may generally increase from frequency band 210*a* to frequency band 210*d*. The magnitude of the audio signal 202 may remain generally constant from frequency band 210*e* to 210*g*. The magnitude of the audio signal 202 may peak again in frequency band 210*h*. The magnitude of the audio signal 202 may decline in frequency bands 210*i* and 210*j*.

The processing module may analyze each of the frequency bands 210 to determine if the frequency bands include intended audio signal components. In some embodiments, intended audio signal components may be determined to be included in a particular frequency band using the first method described above with respect to FIG. 1 if a difference between an average magnitude of frequency components inside a particular frequency band during a first time frame and an average magnitude of frequency components inside the particular frequency band during a second time frame is more than a magnitude threshold. In these and other embodiments, the second time frame may be after the first time frame. Alternatively or additionally, in some embodiments, intended audio signal components may be determined to be included in a particular frequency band using the second method described above with respect to FIG. 1 if a signal-to-noise ratio calculated from an envelope of the frequency components inside the particular frequency band during a first duration of time and an envelope of the frequency components inside the particular frequency band during a second duration of time is more than a noise threshold. In these and other embodiments, the second duration of time may be longer than the first duration of time and the second duration of time may overlap the first duration of time. In some embodiments, the magnitude threshold and the noise threshold may be different for different frequency bands.

The magnitude thresholds and the noise thresholds for different frequency bands may be determined through phonemes analysis of human speech. A phoneme may be a unit of sound in speech. Regular human speech in a particular language (e.g., English) may include phonemes of different magnitude, frequency, and duration. Phonemes in other languages may include different magnitudes, frequencies, and/or durations. By analyzing the phonemes of a particular language, relative magnitudes above which human speech does not normally rise for a particular frequency may be determined. Thus, magnitude thresholds may be determined for each frequency band for a particular language. Similarly, the noise thresholds may be based on the phonemes of a particular language. Each frequency band may have different noise thresholds. In some embodiments, the magnitude thresholds may be determined based on amplification factors associated with the system.

The audio signal 202 may be determined to not include intended audio signal components using the first method described above with respect to FIG. 1 in frequency bands 210*d* and 210*i* between the first point in time and the second point in time as seen in FIGS. 2A and 2B. The audio signal 202 may be determined to not include intended audio signal components in frequency bands 210*d* and 210*i* because a difference between an envelope of the frequency components during a first time frame and an envelope of the frequency components during a second time frame may be less than a magnitude threshold. FIGS. 2A and 2B depict the magnitude of the frequency components in frequency bands 210*d* and 210*i* as not changing between the first point in time and the second point in time. The audio signal 202 may be determined to include intended audio signal components in the other frequency bands between the first point in time and the second point in time. Additionally, in some embodiments, the audio signal 202 may be determined to not include intended audio signal components prior to the first point in time depicted in FIG. 2*a* and after the second point in time depicted in FIG. 2*b*.

The communication device may be configured to attenuate the audio signal 202 to produce the attenuated audio signal 204 depicted in FIG. 2*c*. In these and other embodiments, the attenuated audio signal 204 may be the audio signal 202 of FIGS. 2A and 2B with the audio signal 202 attenuated in frequency bands 210*d* and 210*i* determined to not include intended audio signal components between the first point in time of FIG. 2*a* and the second point in time of FIG. 2*b*. For example, the audio signal 202 in frequency bands 210*a*, 210*b*, 210*c*, 210*e*, 210*f*, 210*g*, 210*h*, and 210*j* may not be attenuated for the attenuated audio signal 204. In these and other embodiments, the audio signal 202 may be attenuated in a similar manner as described above with respect to FIG. 1.

In some embodiments, the attenuation of the audio signal 202 in a frequency band may be performed iteratively. In these and other embodiments, the audio signal 202 may be attenuated in a step-down fashion. For example, the audio signal 202 may be attenuated by a fixed amount, e.g., 1, 5, 10, or any other amount of decibels. In some embodiments, the audio signal 202 may similarly be determined to not include intended audio signal components using the second method described above with respect to FIG. 1 in frequency bands 210*d* and 210*i* between the first point in time and the second point in time as seen in FIGS. 2A and 2B. In these and other embodiments, the audio signal 202 may similarly be attenuated as described above.

Modifications, additions, or omissions may be made to the schematic diagrams 220, 230, and 240 without departing from the scope of the present disclosure. For example, in some embodiments, the audio signal 202 may be separated into more or fewer frequency bands than ten. Alternatively or additionally, in some embodiments, the audio signal 202 may include intended audio signal components in more or fewer than eight frequency bands. Alternatively or additionally, in some embodiments, the audio signal 202 may include intended audio signal components in some frequency bands 210 between a first point in time and a second point in time but not between a third point in time and a fourth point in time. Alternatively or additionally, in some embodiments, the audio signal 202 may be separated into frequency bands 210 between a frequency of 0 kHz and 5 kHz.

Figure 3:
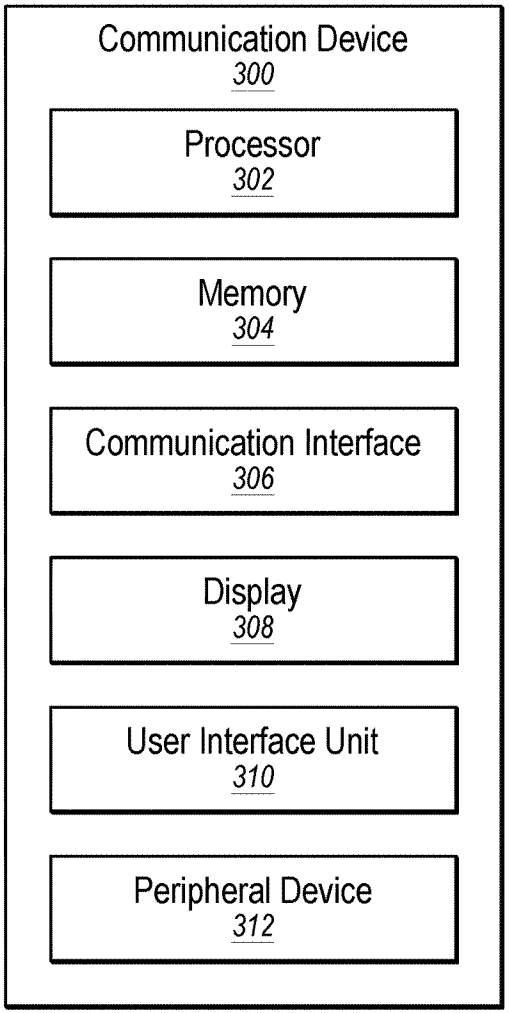
FIG. 3 illustrates an example communication device that may be used in reducing noise in an audio signal.

FIG. 3 illustrates an example communication device 300 that may be used in processing audio signals and improving a signal-to-noise ratio. The communication device 300 may be arranged in accordance with at least one embodiment described in the present disclosure. The communication device 300 may include a processor 302, a memory 304, a communication interface 306, a display 308, a user interface unit 310, and a peripheral device 312, which all may be communicatively coupled. In some embodiments, the communication device 300 may be part of any of the systems or devices described in this disclosure. For example, the communication device 300 may be part of any of the frequency band processing system 100 of FIG. 1, the first communication device 904, the second communication device 910, or the communication system 908 of FIG. 9. In some embodiments, the communication device 300 may be part of a phone console.

Generally, the processor 302 may include any suitable special-purpose or general-purpose computer, computing entity, or processing device including various computer hardware or software modules and may be configured to execute instructions stored on any applicable computer-readable storage media. For example, the processor 302 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data, or any combination thereof.

Although illustrated as a single processor in FIG. 3, it is understood that the processor 302 may include any number of processors distributed across any number of networks or physical locations that are configured to perform individually or collectively any number of operations described herein. In some embodiments, program instructions may be loaded into the memory 304. In these and other embodiments, the processor 302 may interpret and/or execute program instructions and/or process data stored in the memory 304. For example, the communication device 300 may be part of the frequency band processing system 100 of FIG. 1, the first communication device 904, the second communication device 910, or the communication system 908 of FIG. 9. In these and other embodiments, the program instructions may include the processor 302 processing an audio signal and improving a signal-to-noise ratio in the audio signal.

The memory 304 may include computer-readable storage media for carrying or having computer-executable instructions or data structures stored thereon. Such computer-readable storage media may be any available media that may be accessed by a general-purpose or special-purpose computer, such as the processor 302. By way of example, and not limitation, such computer-readable storage media may include non-transitory computer-readable storage media including Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage media which may be used to carry or store desired program code in the form of computer-executable instructions or data structures and which may be accessed by a general-purpose or special-purpose computer. Combinations of the above may also be included within the scope of computer-readable storage media. Computer-executable instructions may include, for example, instructions and data configured to cause the processor 302 to perform a certain operation or group of operations, such as one or more blocks of the method 700 or the method 800. Additionally or alternatively, in some embodiments, the instructions may be configured to cause the processor 302 to perform the operations of the frequency band processing system 100 of FIG. 1. In these and other embodiments, the processor 302 may be configured to execute instructions to separate an audio signal into frequency bands. In these and other embodiments, the analysis filter bank 110 and/or the synthesis filter bank 130 of FIG. 1 may be implemented as a digital filter bank, which may be implemented as program code executed by the processor 302. Alternatively or additionally, in some embodiments, the frequency band processing system 100 of FIG. 1 may include an analog filter bank as the analysis filter bank 110 or the synthesis filter bank 130 of FIG. 1. In these and other embodiments, the communication device 300 may include one or more physical analog filter banks. In some embodiments, one of the analysis filter bank 110 and the synthesis filter bank 130 may be implemented as program code executed by the processor 302 and the other may be implemented as one or more analog filter banks.

The communication interface 306 may include any component, device, system, or combination thereof that is configured to transmit or receive information over a network. In some embodiments, the communication interface 306 may communicate with other devices at other locations, the same location, or even other components within the same system. For example, the communication interface 306 may include a modem, a network card (wireless or wired), an infrared communication device, a wireless communication device (such as an antenna), and/or chipset (such as a Bluetooth device, an 802.6 device (e.g., Metropolitan Area Network (MAN)), a WiFi device, a WiMax device, cellular communication facilities, etc.), plain old telephone service (POTS), and/or the like. The communication interface 306 may permit data to be exchanged with a network and/or any other devices or systems described in the present disclosure.

The display 308 may be configured as one or more displays, like an LCD, LED, or other type display. The display 308 may be configured to present video, text captions, user interfaces, and other data as directed by the processor 302.

The user interface unit 310 may include any device to allow a user to interface with the communication device 300. For example, the user interface unit 310 may include a mouse, a track pad, a keyboard, a touchscreen, a telephone switch hook, a telephone keypad, volume controls, and/or other special purpose buttons, among other devices. The user interface unit 310 may receive input from a user and provide the input to the processor 302.

The peripheral device 312 may include one or more devices. For example, the peripheral devices may include a microphone, an imager, and/or a speaker, among other peripheral devices. In these and other embodiments, the microphone may be configured to capture audio. The imager may be configured to capture digital images. The digital images may be captured in a manner to produce video or image data. In some embodiments, the speaker may play audio received by the communication device 300 or otherwise generated by the communication device 300. In some embodiments, the processor 302 may be configured to process audio signals and improve a signal-to-noise ratio of the audio signals, which may help reduce noise in the audio output by the speaker.

Modifications, additions, or omissions may be made to the communication device 300 without departing from the scope of the present disclosure.

Figure 4A:
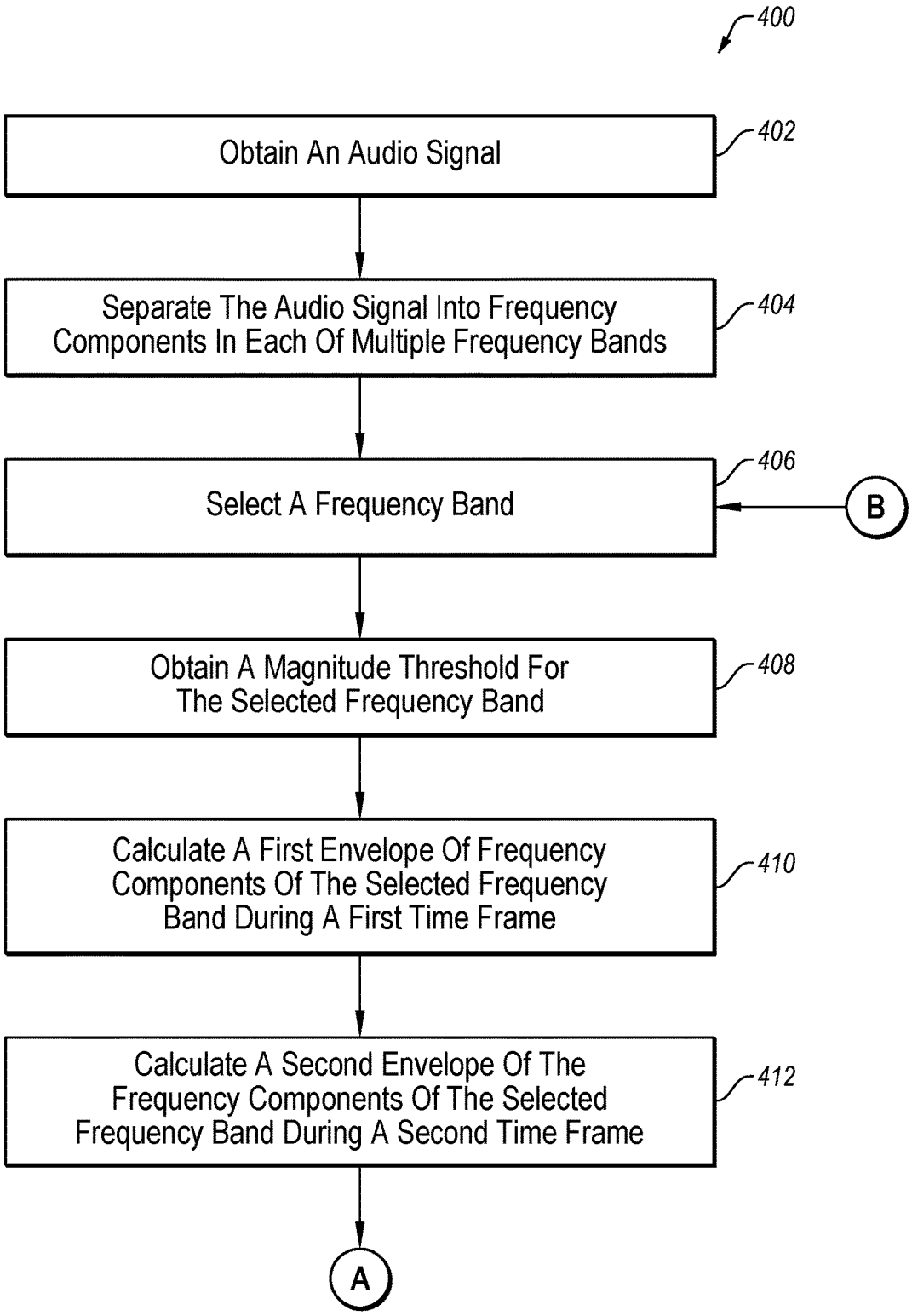
FIGS. 4A and 4B illustrate an example process related to reducing noise.
Figure 4B:
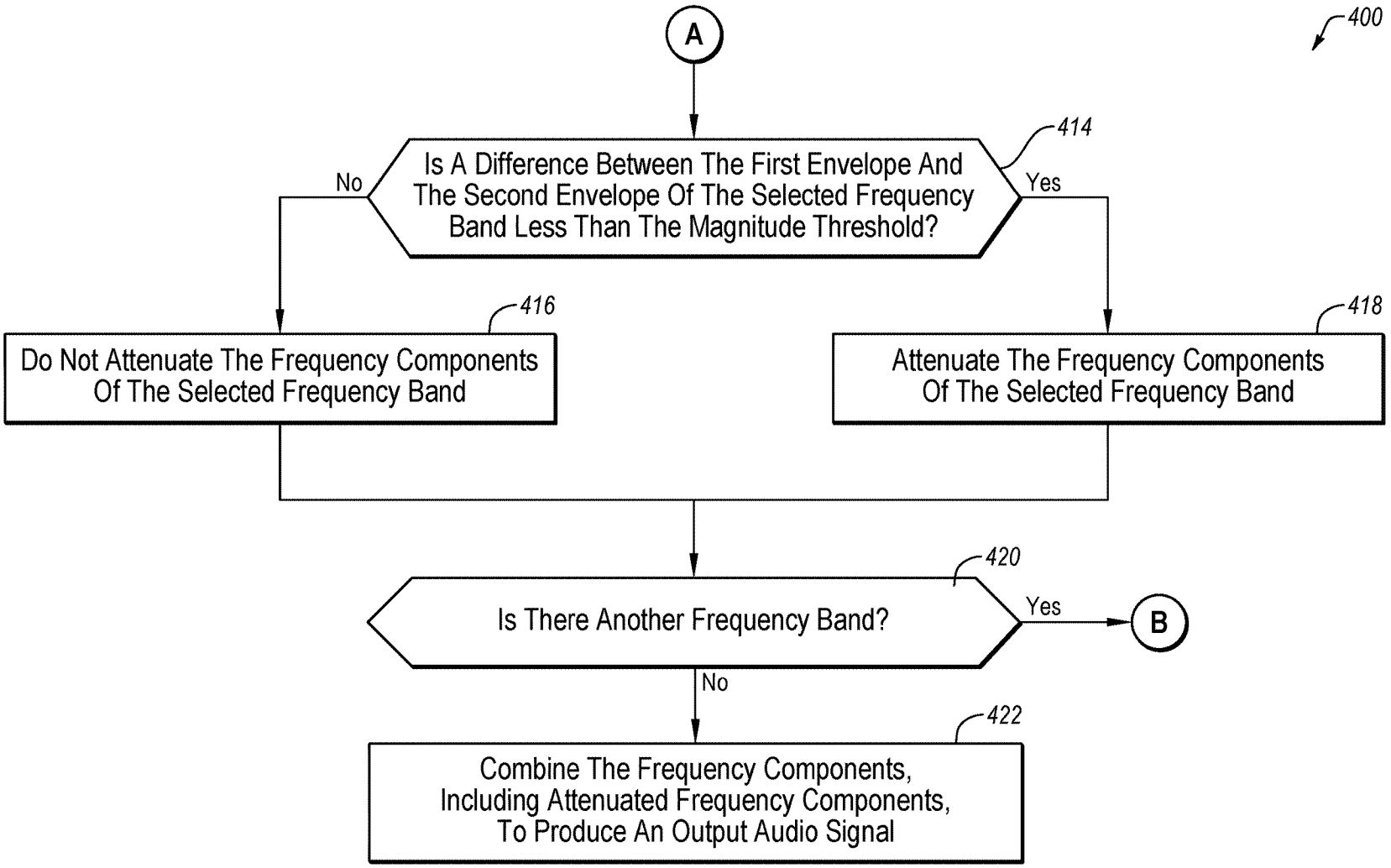

FIGS. 4A and 4B illustrate an example process related to processing audio and improving a signal-to-noise ratio. The process 400 may be arranged in accordance with at least one embodiment described in the present disclosure. The process 400 may be performed, in whole or in part, in some embodiments, by a system and/or environment, such as the processing system 100, the communication device 300, and/or the communication device 910 of FIGS. 1, 3, and 9, respectively. In these and other embodiments, the process 400 may be performed based on the execution of instructions stored on one or more non-transitory computer-readable media. Although illustrated as discrete blocks, various blocks may be divided into additional blocks, combined into fewer blocks, or eliminated, depending on the desired implementation.

The process 400 may begin at block 402, where an audio signal may be obtained. In block 404, the audio signal may be separated into frequency components in each of multiple frequency bands. In some embodiments, each of the multiple frequency bands may include an approximately equal bandwidth of frequency. In some embodiments, one or more of the multiple frequency bands may include different bandwidths of frequency. In block 406, one of the multiple frequency bands may be selected.

In block 408, a magnitude threshold for the selected frequency band may be obtained. In some embodiments, the magnitude threshold may be based on the selected frequency band. In block 410, a first envelope of frequency components of the selected frequency band may be calculated during a first time frame. In some embodiments, the first envelope may be calculated as a first RMS average magnitude of the selected frequency components during the first time frame. In block 412, a second envelope of the frequency components of the selected frequency band may be calculated during a second time frame. In some embodiments, the second time frame may be after the first time frame. In some embodiments, the second envelope may be calculated as a second RMS average magnitude of the selected frequency components during the second time frame.

In block 414, it may be determined if a difference between the first envelope and the second envelope of the selected frequency band is less than the magnitude threshold. In response to the difference being less than the magnitude threshold ("Yes" at block 414), the process 400 may proceed to block 418. In response to the difference not being less than the magnitude threshold ("No" at block 414), the process 400 may proceed to block 416.

In block 416, the frequency components of the selected frequency band may not be attenuated. In some embodiments, this may include not altering the frequency components of the selected frequency band. In block 418, the frequency components of the selected frequency band may be attenuated. In some embodiments, frequency components may be attenuated from a first point in time to a second point in time, in response to the selected frequency band satisfying the condition in block 414 between the first point in time and the second point in time. In these and other embodiments, the frequency components may be attenuated until the frequency components are determined to include speech. In some embodiments, the frequency components of the selected frequency band may be attenuated by a fixed percentage amount. In some embodiments, the frequency components may be attenuated by an amount based on the difference between the first envelope and the second envelope.

In block 420, it may be determined if there is another frequency band. In response to there being another frequency band ("Yes" at block 420), the process may return to block 406. In response to there not being another frequency band ("No" at block 420), the process may proceed to block 422. In block 422, the frequency components, including attenuated frequency components, may be combined to produce an output audio signal.

One skilled in the art will appreciate that, for this and other processes, operations, and methods disclosed herein, the functions and/or operations performed may be implemented in differing order. Furthermore, the outlined functions and operations are only provided as examples, and some of the functions and operations may be optional, combined into fewer functions and operations, or expanded into additional functions and operations without detracting from the essence of the disclosed embodiments.

For example, in some embodiments, the blocks 406 through 420 for each frequency band may be performed as a parallel process. In these and other embodiments, multiple processors may perform the operations of blocks 406 through 420 for each of the frequency bands simultaneously.

Figure 5A:
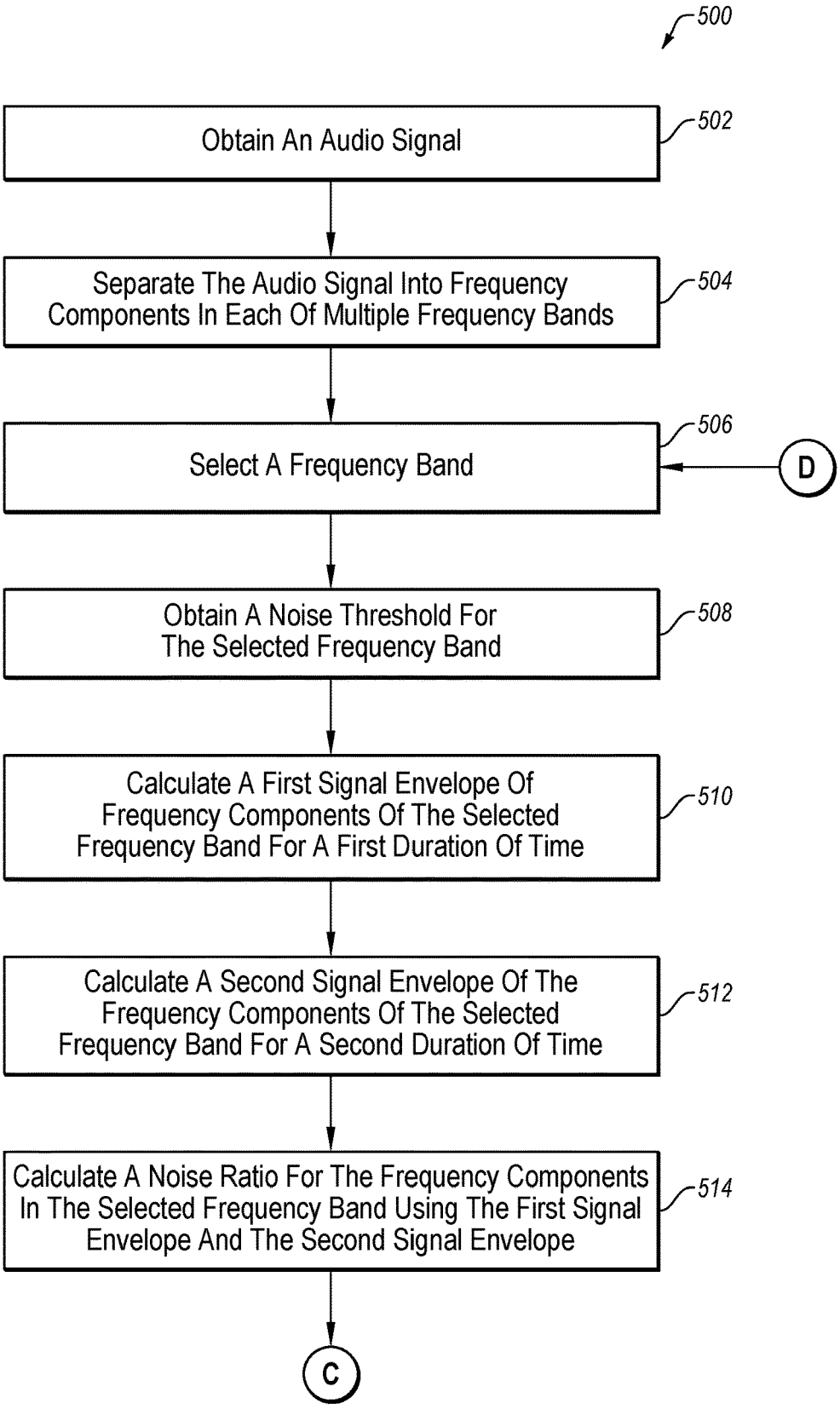
FIGS. 5A and 5B illustrate another example process related to reducing noise.
Figure 5B:
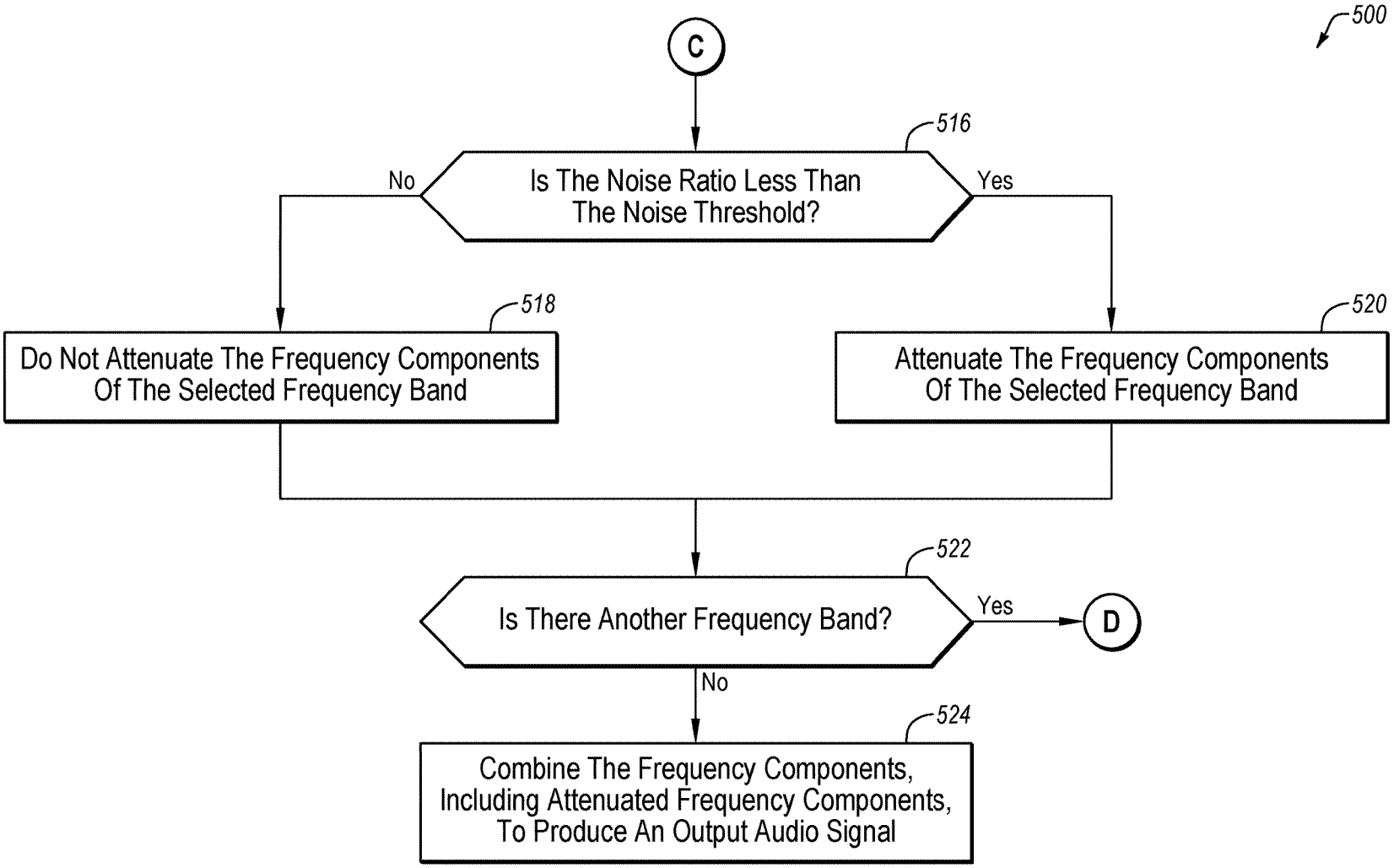

FIGS. 5A and 5B illustrate another example process related to processing audio and improving a signal-to-noise ratio. The process 500 may be arranged in accordance with at least one embodiment described in the present disclosure. The process 500 may be performed, in whole or in part, in some embodiments, by a system and/or environment, such as the processing system 100, the system 300, and/or the communication device 910 of FIGS. 1, 3, and 9, respectively. In these and other embodiments, the process 500 may be performed based on the execution of instructions stored on one or more non-transitory computer-readable media. Although illustrated as discrete blocks, various blocks may be divided into additional blocks, combined into fewer blocks, or eliminated, depending on the desired implementation.

The process 500 may begin at block 502, where an audio signal may be obtained. In block 504, the audio signal may be separated into frequency components in each of multiple frequency bands. In some embodiments, each of the multiple frequency bands may include an approximately equal bandwidth of frequency. In some embodiments, one or more of the multiple frequency bands may include different bandwidths of frequency. In block 506, one of the multiple frequency bands may be selected.

In block 508, a noise threshold for the selected frequency band may be obtained. In some embodiments, the noise threshold may be based on the selected frequency band. In block 510, a first signal envelope of frequency components of the selected frequency band may be calculated for a first duration of time. In some embodiments, the first signal envelope may be calculated as a first average magnitude of the selected frequency components during the first duration of time. Alternatively or additionally, in some embodiments, the first signal envelope may be calculated as a first average power of the selected frequency components during the first duration of time. In block 512, a second signal envelope of the frequency components of the selected frequency band may be calculated for a second duration of time. In some embodiments, the second duration of time may be longer than the first duration of time. In some embodiments, the second duration of time may overlap the first duration of time. In some embodiments, the second signal envelope may be calculated as a second average magnitude of the selected frequency components during the second duration of time.

In block 514, a noise ratio for the frequency components in the selected frequency band may be calculated using the first signal envelope and the second signal envelope. In block 516, it may be determined if the noise ratio is less than the noise threshold. In response to the noise ratio being less than the noise threshold ("Yes" at block 516), the process 500 may proceed to block 520. In response to the noise ratio not being less than the noise threshold ("No" at block 516), the process 500 may proceed to block 518.

In block 518, the frequency components of the selected frequency band may not be attenuated. In some embodiments, this may include not altering the frequency components of the selected frequency band. In block 520, the frequency components of the selected frequency band may be attenuated. In some embodiments, frequency components may be attenuated from a first point in time to a second point in time, in response to the selected frequency band satisfying the condition in block 516 between the first point in time and the second point in time. In these and other embodiments, the frequency components may be attenuated until the frequency components are determined to include speech. In some embodiments, the frequency components of the selected frequency band may be attenuated by a fixed percentage amount. In some embodiments, the frequency components may be attenuated by an amount based on the noise ratio, an amount based on the noise ratio and the noise threshold, or an amount based on interpolation of the noise ratio between the noise threshold and a second noise threshold.

In block 522, it may be determined if there is another frequency band. In response to there being another frequency band ("Yes" at block 522), the process may return to block 506. In response to there not being another frequency band ("No" at block 522), the process may proceed to block 524. In block 524, the frequency components, including attenuated frequency components, may be combined to produce an output audio signal.

One skilled in the art will appreciate that, for this and other processes, operations, and methods disclosed herein, the functions and/or operations performed may be implemented in differing order. Furthermore, the outlined functions and operations are only provided as examples, and some of the functions and operations may be optional, combined into fewer functions and operations, or expanded into additional functions and operations without detracting from the essence of the disclosed embodiments.

For example, in some embodiments, the blocks 506 through 522 for each frequency band may be performed as a parallel process. In these and other embodiments, multiple processors may perform the operations of blocks 506 through 522 for each of the frequency bands simultaneously.

Figure 6A:
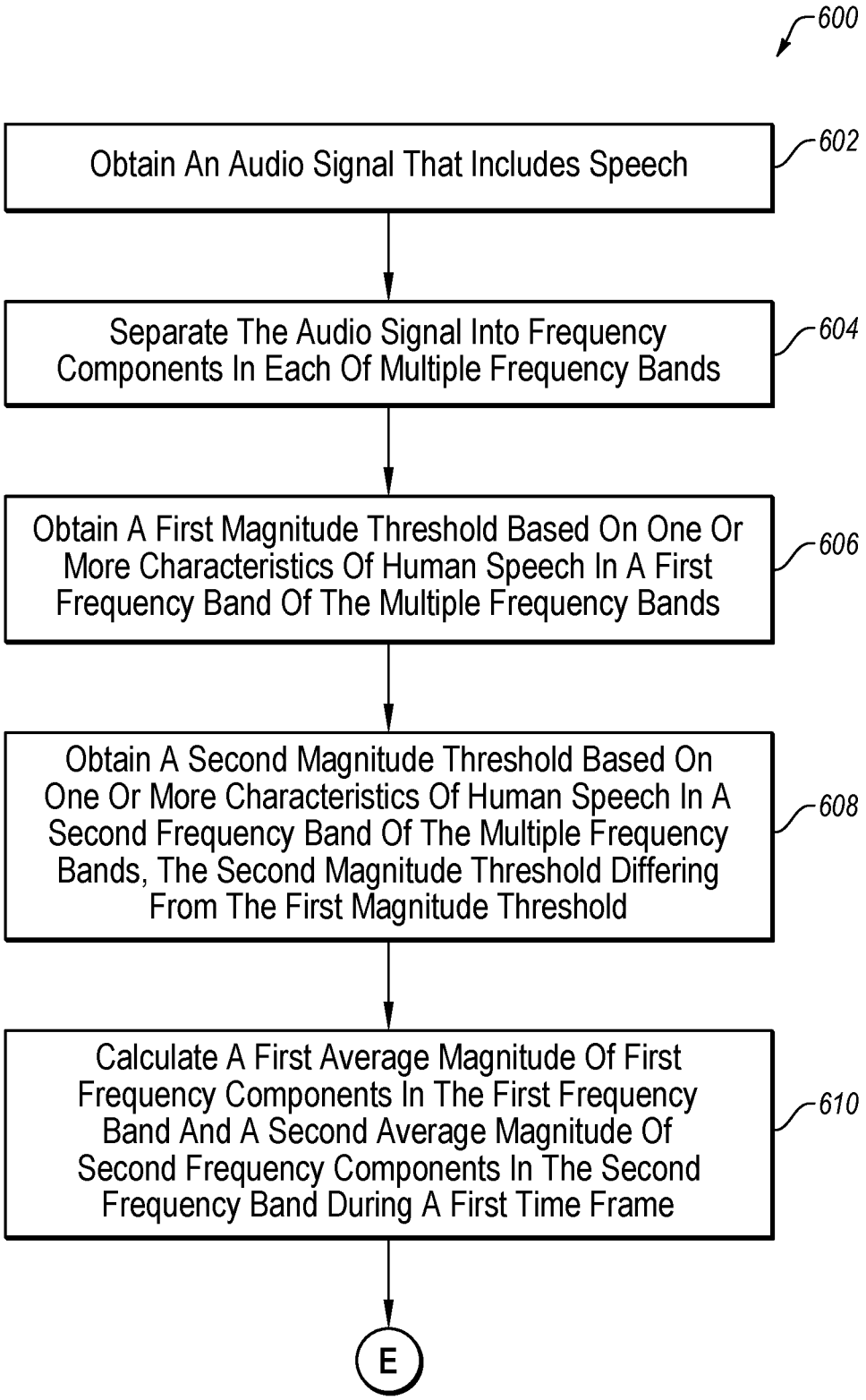
FIGS. 6A and 6B are a flowchart of an example computer-implemented method to reduce noise.
Figure 6B:
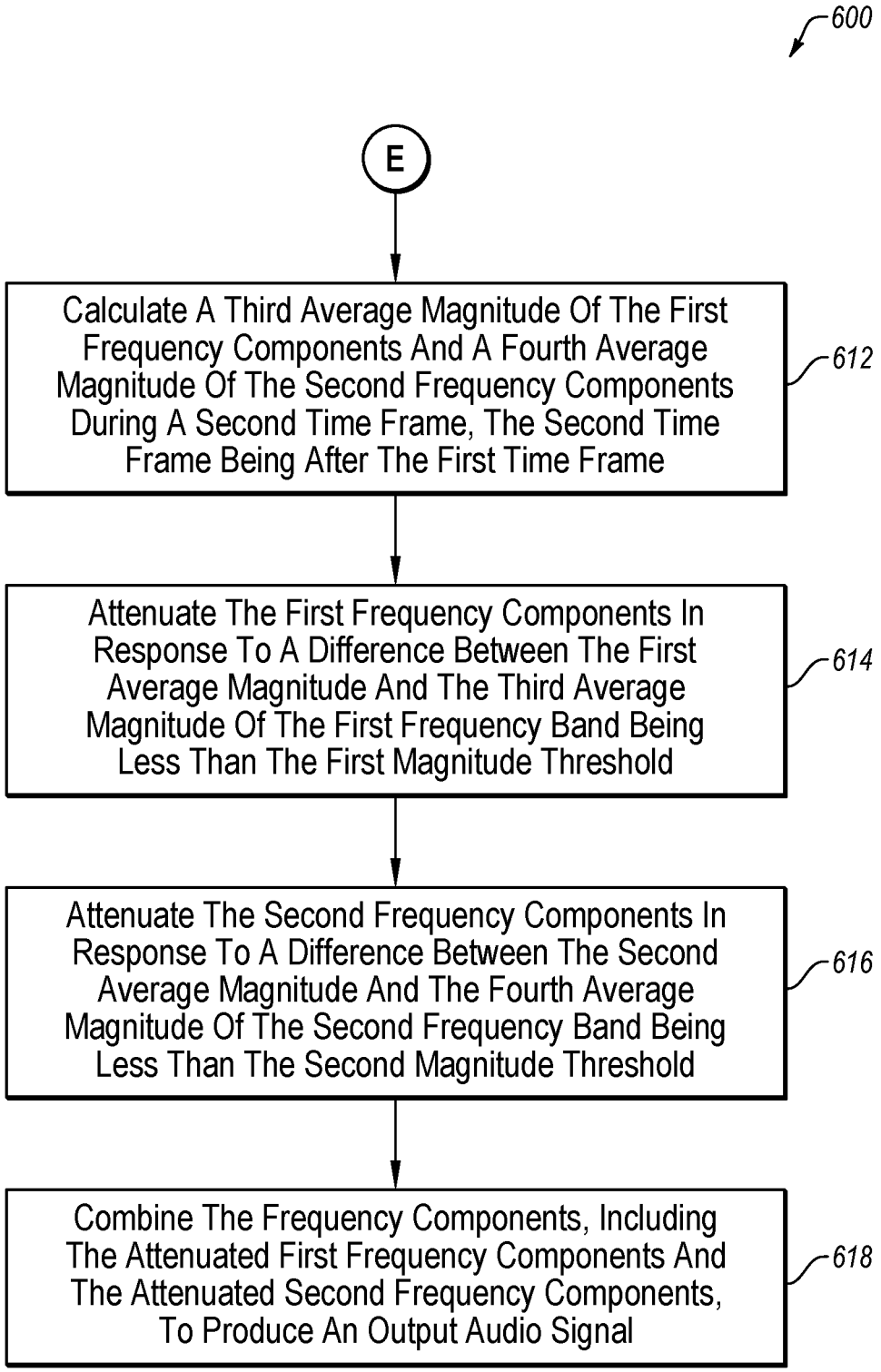

FIGS. 6A and 6B are a flowchart of an example computer-implemented method to reduce noise in an audio signal. The method 600 may be arranged in accordance with at least one embodiment described in the present disclosure. The method 600 may be performed, in whole or in part, in some embodiments, by a system and/or environment, such as the processing system 100, the system 300, and/or the communication device 910 of FIGS. 1, 3, and 9, respectively. In these and other embodiments, the method 600 may be performed based on the execution of instructions stored on one or more non-transitory computer-readable media. Although illustrated as discrete blocks, various blocks may be divided into additional blocks, combined into fewer blocks, or eliminated, depending on the desired implementation.

The method 600 may begin at block 602, where an audio signal that includes speech may be obtained. In block 604, the audio signal may be separated into frequency components in each of multiple frequency bands. In some embodiments, each of the multiple frequency bands may include an approximately equal bandwidth of frequency.

In block 606, a first magnitude threshold may be obtained. The first magnitude threshold may be based on one or more characteristics of human speech in a first frequency band of the multiple frequency bands. In some embodiments, the one or more characteristics of human speech in the first frequency band may include a first range of magnitudes of one or more phonemes in the first frequency band. In some embodiments, the one or more characteristics of human speech in the first frequency band may include phonemes of human speech in the first frequency band.

In block 608, a second magnitude threshold may be obtained. The second magnitude threshold may be based on one or more characteristics of human speech in a second frequency band of the multiple frequency bands. The second magnitude threshold may be different than the first magnitude threshold. In some embodiments, the one or more characteristics of human speech in the second frequency band may include a second range of magnitudes of one or more phonemes in the second frequency band. The one or more phonemes in the second frequency band may be different from the one or more phonemes in the first frequency band.

In block 610, a first average magnitude of first frequency components in the first frequency band and a second average magnitude of second frequency components in the second frequency band may be calculated during a first time frame. In some embodiments, the first average magnitude and the second average magnitude may be RMS averages. In some embodiments, the first time frame may be a duration of 50 ms.

In block 612, a third average magnitude of the first frequency components and a fourth average magnitude of second frequency components may be calculated during a second time frame. The second time frame may be after the first time frame. In some embodiments, the third average magnitude and the fourth average magnitude may be RMS averages. In some embodiments, the second time frame may be a duration of 50 ms. In some embodiments, the first magnitude threshold may be based on the one or more characteristics of human speech in the first frequency band, the duration of the first time frame, and the duration of the second time frame.

In block 614, the first frequency components may be attenuated in response to a difference between the first average magnitude and the third average magnitude of the first frequency band being less than the first magnitude threshold. In some embodiments, the first frequency components may be attenuated by a fixed percentage amount. In some embodiments, the first frequency components may be attenuated based on the difference between the first average magnitude and the second average magnitude.

In block 616, the second frequency components may be attenuated in response to a difference between the second average magnitude and the fourth average magnitude of the second frequency band being less than the second magnitude threshold.

In block 618, the frequency components, including the attenuated first frequency components and the attenuated second frequency components, may be combined to produce an output audio signal.

One skilled in the art will appreciate that, for this and other processes, operations, and methods disclosed herein, the functions and/or operations performed may be implemented in differing order. Furthermore, the outlined functions and operations are only provided as examples, and some of the functions and operations may be optional, combined into fewer functions and operations, or expanded into additional functions and operations without detracting from the essence of the disclosed embodiments.

Figure 7:
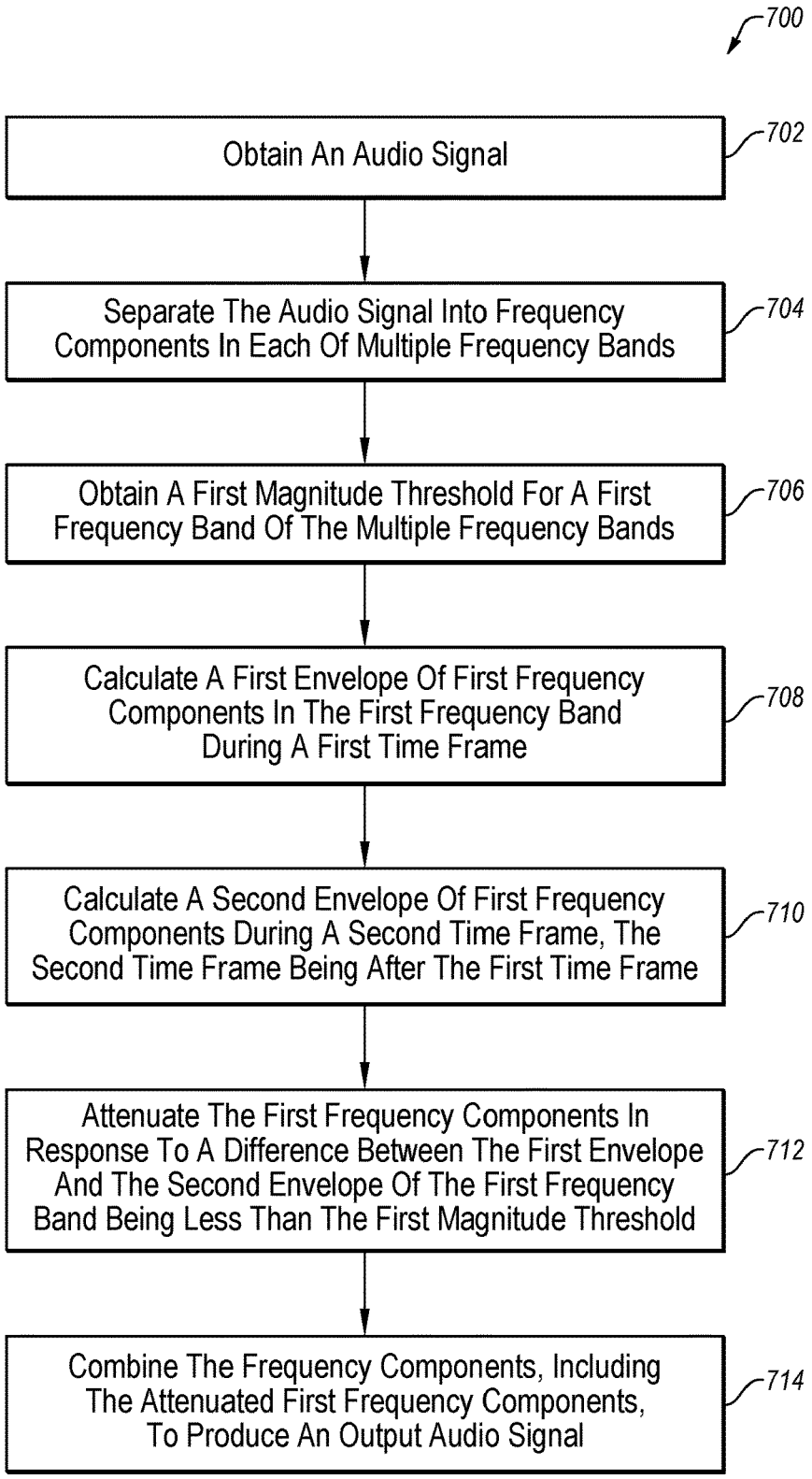
FIG. 7 is a flowchart of another example computer-implemented method to reduce noise.

FIG. 7 is a flowchart of an example computer-implemented method to reduce noise in an audio signal. The method 700 may be arranged in accordance with at least one embodiment described in the present disclosure. The method 700 may be performed, in whole or in part, in some embodiments, by a system and/or environment, such as the processing system 100, the system 300, and/or the communication device 910 of FIGS. 1, 3, and 9, respectively. In these and other embodiments, the method 700 may be performed based on the execution of instructions stored on one or more non-transitory computer-readable media. Although illustrated as discrete blocks, various blocks may be divided into additional blocks, combined into fewer blocks, or eliminated, depending on the desired implementation.

The method 700 may begin at block 702, where an audio signal may be obtained. In block 704, the audio signal may be separated into frequency components in each of multiple frequency bands. In some embodiments, each of the multiple frequency bands may include an approximately equal bandwidth of frequency. In block 706, a first magnitude threshold for a first frequency band of the multiple frequency bands may be obtained. In some embodiments, the first magnitude threshold may be based on one or more phonemes of human speech in the first frequency band.

In block 708, a first envelope of first frequency components in the first frequency band may be calculated during a first time frame. In some embodiments, the first envelope may be a first average magnitude of the first frequency components during the first time frame. In block 710, a second envelope of the first frequency components may be calculated during a second time frame. The second time frame may be after the first time frame. In some embodiments, the second envelope may be a second average magnitude of the first frequency components during the second time frame.

In block 712, the first frequency components may be attenuated in response to a difference between the first envelope and the second envelope of the first frequency band being less than the first magnitude threshold. In some embodiments, the first frequency components may be attenuated by a fixed percentage amount. In some embodiments, the first frequency components may be attenuated based on the difference between the first envelope and the second envelope.

In block 714, the frequency components, including the attenuated first frequency components, may be combined to produce an output audio signal.

One skilled in the art will appreciate that, for this and other processes, operations, and methods disclosed herein, the functions and/or operations performed may be implemented in differing order. Furthermore, the outlined functions and operations are only provided as examples, and some of the functions and operations may be optional, combined into fewer functions and operations, or expanded into additional functions and operations without detracting from the essence of the disclosed embodiments.

For example, in some embodiments, the method 700 may further include obtaining a second magnitude threshold for a second frequency band of the multiple frequency bands. In these and other embodiments, the method 700 may also include calculating a third envelope of second frequency components in the second frequency band during the first time frame. In these and other embodiments, the method 700 may further include calculating a fourth envelope of the second frequency components during the second time frame. In these and other embodiments, the method 700 may also include attenuating the second frequency components in response to a difference between the third envelope and the fourth envelope of the second frequency band being less than the second magnitude threshold. In these and other embodiments, combining the frequency components may further include combining the attenuated first frequency components and the attenuated second frequency components.

Figure 8A:
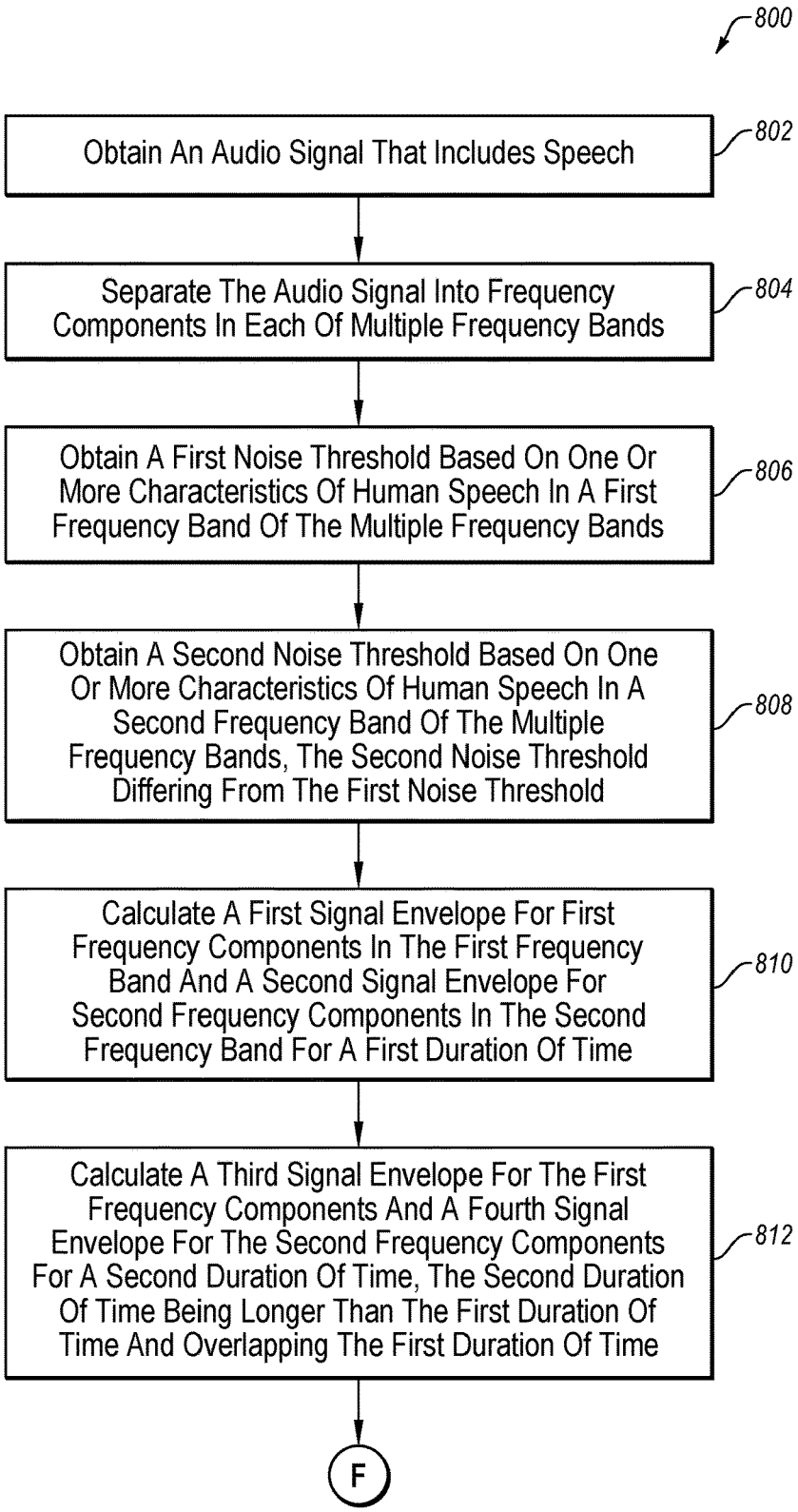
FIGS. 8A and 8B are a flowchart of another example computer-implemented method to reduce noise.
Figure 8B:
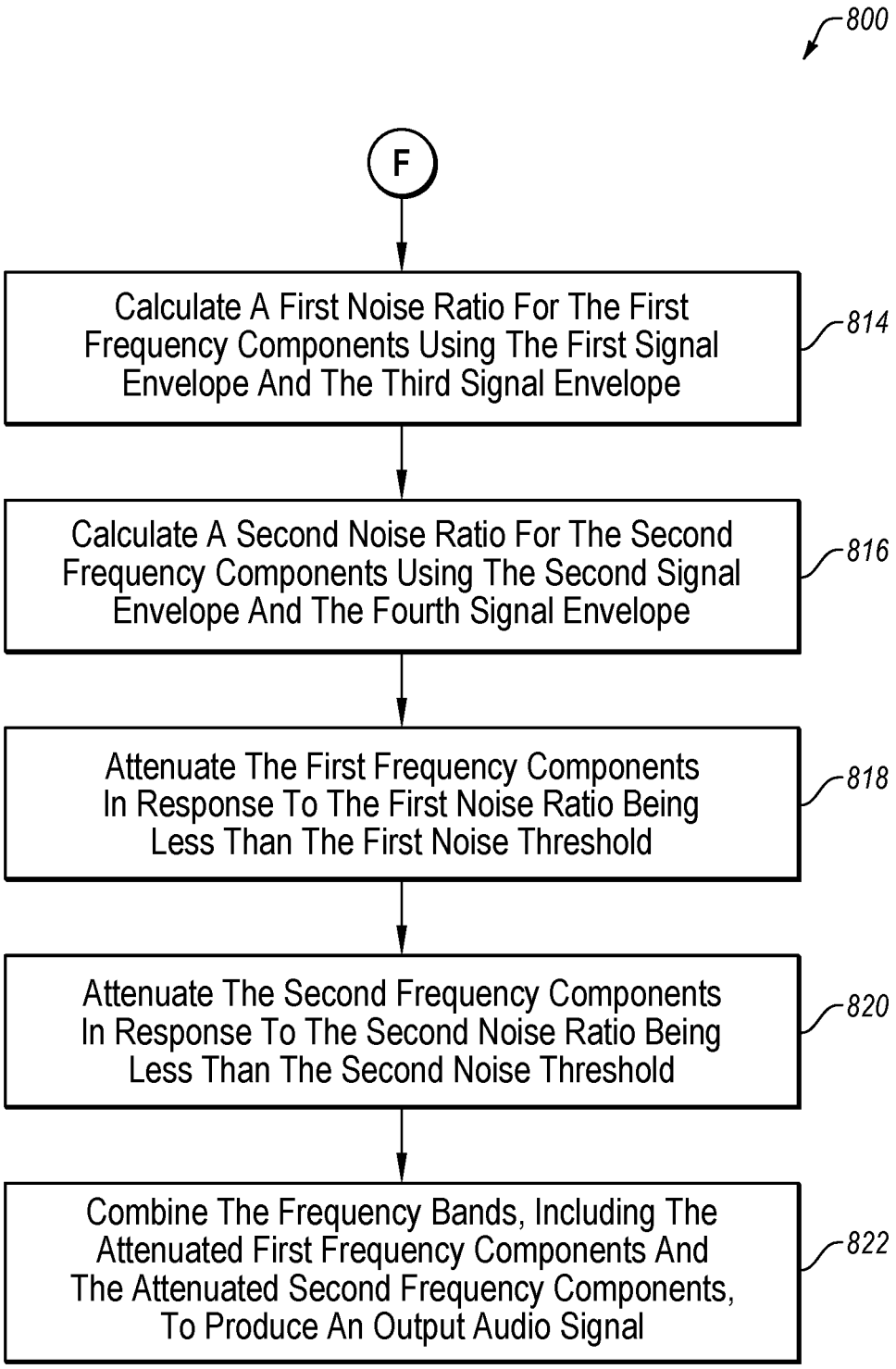

FIGS. 8A and 8B are a flowchart of an example computer-implemented method to reduce noise in an audio signal. The method 800 may be arranged in accordance with at least one embodiment described in the present disclosure. The method 800 may be performed, in whole or in part, in some embodiments, by a system and/or environment, such as the processing system 100, the system 300, and/or the communication device 910 of FIGS. 1, 3, and 9, respectively. In these and other embodiments, the method 800 may be performed based on the execution of instructions stored on one or more non-transitory computer-readable media. Although illustrated as discrete blocks, various blocks may be divided into additional blocks, combined into fewer blocks, or eliminated, depending on the desired implementation.

The method 800 may begin at block 802, where an audio signal that includes speech may be obtained. In block 804, the audio signal may be separated into frequency components in each of multiple frequency bands. In block 806, a first noise threshold may be obtained. The first noise threshold may be based on one or more characteristics of human speech in a first frequency band of the multiple frequency bands. In block 808, a second noise threshold may be obtained. The second noise threshold may be based on one or more characteristics of human speech in a second frequency band of the multiple frequency bands. The second noise threshold may be different than the first noise threshold.

In block 810, a first signal envelope for first frequency components in the first frequency band and a second signal envelope for second frequency components in the second frequency band may be calculated for a first duration of time. In block 812, a third signal envelope for the first frequency components and a fourth signal envelope for the second frequency components may be calculated for a second duration of time. The second duration of time may be longer than the first duration of time. The second duration of time may overlap the first duration of time.

In block 814, a first noise ratio for the first frequency components may be calculated using the first signal envelope and the third signal envelope. In block 816, a second noise ratio for the second frequency components may be calculated using the second signal envelope and the fourth signal envelope.

In block 818, the first frequency components may be attenuated in response to the first noise ratio being less than the first noise threshold. In some embodiments, the first frequency components may be attenuated by a fixed percentage amount. Alternatively or additionally, in some embodiments, the first frequency components may be attenuated by an amount based on the first noise ratio. Alternatively or additionally, in some embodiments, the first frequency components may be attenuated by an amount based on the first noise ratio and the first noise threshold. Alternatively or additionally, in some embodiments, the first frequency components may be attenuated by an amount based on interpolation of the first noise ratio between the first noise threshold and a third noise threshold. In block 820, the second frequency components may be attenuated in response to the second noise ratio being less than the second noise threshold.

In block 822, the frequency bands, including the attenuated first frequency components and the attenuated second frequency components, may be combined to produce an output audio signal.

One skilled in the art will appreciate that, for this and other processes, operations, and methods disclosed herein, the functions and/or operations performed may be implemented in differing order. Furthermore, the outlined functions and operations are only provided as examples, and some of the functions and operations may be optional, combined into fewer functions and operations, or expanded into additional functions and operations without detracting from the essence of the disclosed embodiments.

Figure 9:
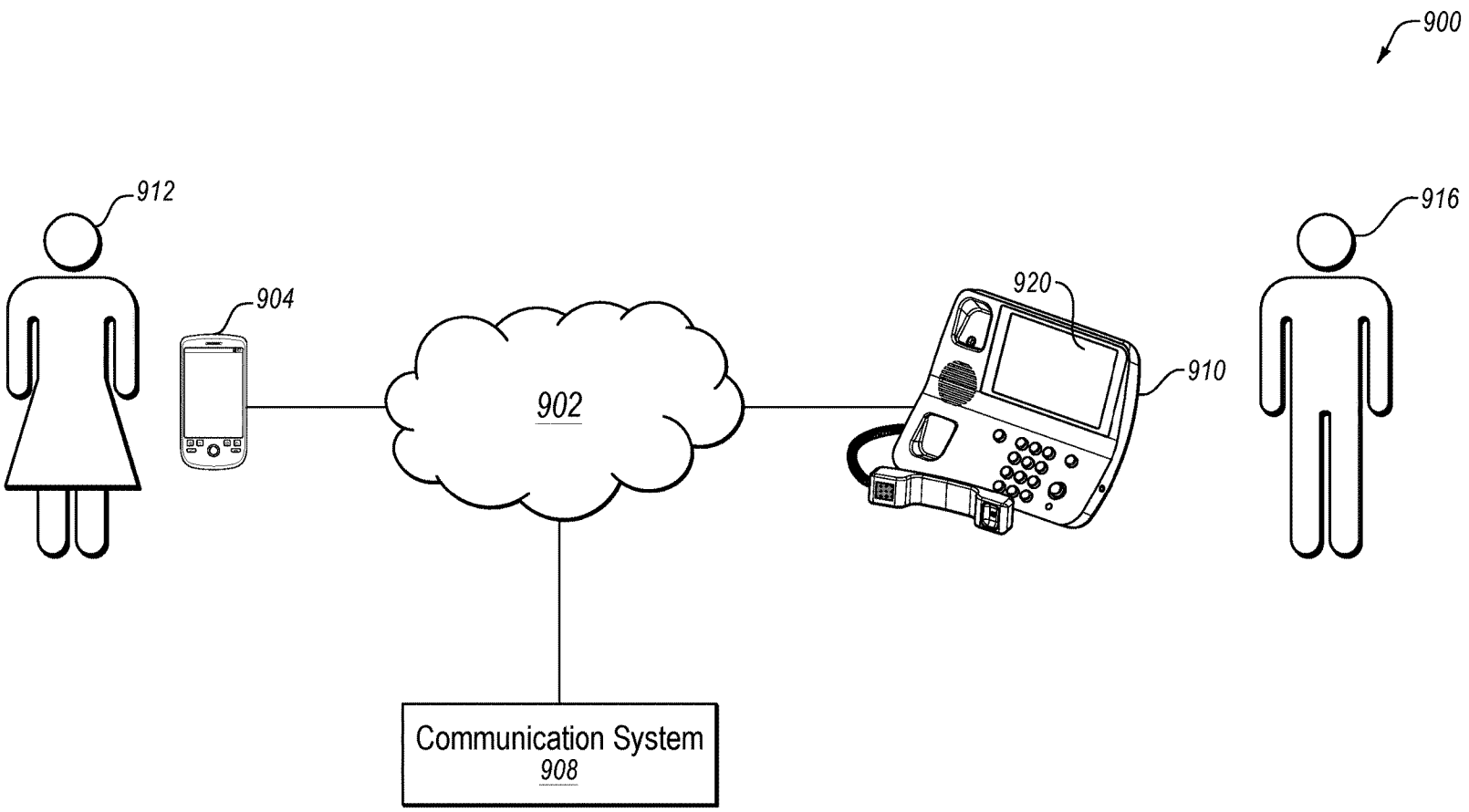
FIG. 9 illustrates an example communication system that may reduce noise.

FIG. 9 illustrates an example environment 900 that includes an example system that may process audio and improve a signal-to-noise ratio. The environment 900 may be arranged in accordance with at least one embodiment described in the present disclosure. The environment 900 may include a network 902, a first communication device 904, a communication system 908, and a second communication device 910.

The network 902 may be configured to communicatively couple the first communication device 904, the communication system 908, and the second communication device 910. In some embodiments, the network 902 may be any network or configuration of networks configured to send and receive communications between systems and devices. In some embodiments, the network 902 may include a wired network or wireless network, and may have numerous different configurations. In some embodiments, the network 902 may also be coupled to or may include portions of a telecommunications network, including telephone lines such as a public switch telephone network (PSTN) line, for sending data in a variety of different communication protocols, such as a protocol used by a plain old telephone system (POTS).

Each of the first communication device 904 and the second communication device 910 may be any electronic or digital computing device. For example, each of the first communication device 904 and the second communication device 910 may include a desktop computer, a laptop computer, a smartphone, a mobile phone, a tablet computer, a telephone, a phone console, or any other computing device. In some embodiments, each of the first communication device 904 and the second communication device 910 may be configured to establish communication sessions with other devices. For example, each of the first communication device 904 and the second communication device 910 may be configured to establish an outgoing telephone call with another device over a telephone line or communication network. For example, the first communication device 904 may communicate over a wireless cellular network and the second communication device 910 may communicate over a PSTN line. Alternatively or additionally, the first communication device 904 and the second communication device 910 may communicate over other wired or wireless networks that do not include or only partially include a PSTN. For example, a telephone call or communication session between the first communication device 904 and the second communication device 910 may be a Voice over Internet Protocol (VoIP) telephone call. Alternately or additionally, each of the first communication device 904 and the second communication device 910 may be configured to communicate with other systems over a network, such as the network 902 or another network. In these and other embodiments, the first communication device 904 and the second communication device 910 may receive data from and send data to the communication system 908.

In some embodiments, the first communication device 904 and the second communication device 910 may each include memory and at least one processor, which are configured to perform operations as described in this disclosure, among other operations. In some embodiments, the first communication device 904 and the second communication device 910 may include computer-readable instructions that are configured to be executed by the first communication device 904 and the second communication device 910 to perform operations described in this disclosure.

In some embodiments, the second communication device 910 may be configured to process audio and improve a signal-to-noise ratio of the audio. In some embodiments, the audio signal may be obtained during a communication session, such as a voice or video call, between the first communication device 904 and the second communication device 910. In these and other embodiments, the audio signal may originate from the second communication device 910 or the first communication device 904. For example, the audio signal may be generated by a microphone of the second communication device 910. Alternatively or additionally, the audio signal may be an audio signal stored on the second communication device 910, such as recorded audio of a message from the user 912, a message from another user, audio books or other recordings, or other stored audio.

In some embodiments, the second communication device 910 may obtain the audio signal without the network 902. For example, in some embodiments, the audio signal may be generated from a microphone of the second communication device 910. Alternatively or additionally, in some embodiments, the audio signal may be obtained from an audio file on a computer-readable storage communicatively coupled with the second communication device 910. Alternatively or additionally, in some embodiments, the audio signal may be obtained from an analog or digital audio storage device such as an audio cassette, a gramophone record, or a compact disc. Alternatively or additionally, in some embodiments, the audio signal may be obtained from a video signal from an analog or a digital video storage device such as a video cassette or an optical disc. In these and other embodiments, the source of the audio signal may not be important. In these and other embodiments, the environment 900 may not include the network 902.

In some embodiments, the audio signal may include noise. In these and other embodiments, the second communication device 910 may perform the operations described above with respect to FIGS. 1-8 to separate the audio signal into frequency bands, attenuate frequency bands determined to include noise, and combine the attenuated frequency bands.

In some embodiments, the communication system 908 may include any configuration of hardware, such as processors, servers, and data storages that are networked together and configured to perform a task. For example, the communication system 908 may include multiple computing systems, such as multiple servers that each include memory and at least one processor, which are networked together and configured to perform operations of processing audio and improving a signal-to-noise ratio, as described in this disclosure. The communication system 908 may perform similar functions as the second communication device 910 or the same functions as the second communication device 910 when processing audio and improving a signal-to-noise ratio.

In some embodiments, the communication system 908 may also be configured to transcribe communication sessions, such as telephone or video calls, between devices such as the second communication device 910 and another device as described in this disclosure. In some embodiments, the presence of noise in an audio signal may hinder the generation of transcriptions of communication sessions. In these and other embodiments, the communication system 908 may transcribe audio generated by other devices and not the second communication device 910 or both the second communication device 910 and other devices, among other configurations.

Further, in some embodiments, the environment 900 may be configured to facilitate an assisted communication session between a hearing-impaired user 916 and a second user, such as a user 912. As used in the present disclosure, a "hearing-impaired user" may refer to a person with diminished hearing capabilities. Hearing-impaired users often have some level of hearing ability that has usually diminished over a period of time such that the hearing-impaired user can communicate by speaking, but that the hearing-impaired user often struggles in hearing and/or understanding others.

In some embodiments, the second communication device 910 may be a captioning telephone that is configured to present transcriptions of the communication session to the hearing-impaired user 916, such as one of the CaptionCall® 57T model family or 67T model family of captioning telephones or a device running the CaptionCall® mobile app. For example, in some embodiments, the second communication device 910 may include a visual display 920 that is integral with the second communication device 910 and that is configured to present text transcriptions of a communication session to the hearing-impaired user 916.

During a captioning communication session, the communication system 908 and the second communication device 910 may be communicatively coupled using networking protocols. At the communication system 908, the audio signal may be transcribed. In some embodiments, to transcribe the audio signal, a call assistant may listen to the audio signal received from the stored audio message and "revoice" the words of the stored message to a speech recognition computer program tuned to the voice of the call assistant. In these and other embodiments, the call assistant may be an operator who serves as a human intermediary between the hearing-impaired user 916 and the stored message. In some embodiments, text transcriptions may be generated by a speech recognition computer as a transcription of the audio signal of the stored message. The text transcriptions may be provided to the second communication device 910 being used by the hearing-impaired user 916 over the one or more networks 902. The second communication device 910 may display the text transcriptions while the hearing-impaired user 916 listens to a message from the user 912. The text transcriptions may allow the hearing-impaired user 916 to supplement the voice signal received from the message and confirm his or her understanding of the words spoken in the message.

Modifications, additions, or omissions may be made to the environment 900 without departing from the scope of the present disclosure. For example, in some embodiments, the environment 900 may not include the communication system 908. Alternatively or additionally, in some embodiments, the environment 900 may not include the first communication device 904 or the network 902.

As indicated above, the embodiments described herein may include the use of a special purpose or general purpose computer (e.g., the processor 302 of FIG. 3) including various computer hardware or software modules, as discussed in greater detail below. Further, as indicated above, embodiments described herein may be implemented using computer-readable media (e.g., the memory 304 of FIG. 3) for carrying or having computer-executable instructions or data structures stored thereon.

In some embodiments, the different components, modules, engines, and services described herein may be implemented as objects or processes that execute on a computing system (e.g., as separate threads). While some of the systems and methods described herein are generally described as being implemented in software (stored on and/or executed by general purpose hardware), specific hardware implementations or a combination of software and specific hardware implementations are also possible and contemplated.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. A computer-implemented method to reduce noise in a signal, the method comprising:

obtaining an audio signal that includes speech;

separating the audio signal into frequency components in each of a plurality of frequency bands;

obtaining a first magnitude threshold that is based on one or more characteristics of human speech in a first frequency band of the plurality of frequency bands;

obtaining a second magnitude threshold that is based on one or more characteristics of human speech in a second frequency band of the plurality of frequency bands, the second magnitude threshold being different than the first magnitude threshold;

calculating a first average magnitude of first frequency components in the first frequency band and a second average magnitude of second frequency components in the second frequency band during a first time frame;

calculating a third average magnitude of the first frequency components and a fourth average magnitude of the second frequency components during a second time frame that is after the first time frame;

in response to a difference or ratio between the first average magnitude and the third average magnitude of the first frequency band being less than the first magnitude threshold, attenuating the first frequency components based on an interpolation of the ratio between the first magnitude threshold and a third magnitude threshold;

in response to a difference or ratio between the second average magnitude and the fourth average magnitude of the second frequency band being less than the second magnitude threshold, attenuating the second frequency components; and combining the frequency components, including the attenuated first frequency components and the attenuated second frequency components, to produce an output audio signal.

2. The method of claim 1, wherein the one or more characteristics of human speech in the first frequency band include a first range of magnitudes of one or more phonemes in the first frequency band and wherein the one or more characteristics of human speech in the second frequency band include a second range of magnitudes of one or more phonemes in the second frequency band, the one or more phonemes in the second frequency band differing from the one or more phonemes in the first frequency band.

3. The method of claim 1, wherein each of the plurality of frequency bands includes an approximately equal bandwidth of frequency.

4. The method of claim 1, wherein attenuating the first frequency components comprises attenuating the first frequency components by a fixed percentage amount.

5. The method of claim 1, wherein attenuating the first frequency components comprises attenuating the first frequency components based on a difference between the first average magnitude and the second average magnitude.

6. The method of claim 1, wherein the one or more characteristics of human speech in the first frequency band include phonemes of human speech in the first frequency band.

7. The method of claim 1, wherein the first magnitude threshold is based on one or more characteristics of human speech in the first frequency band, a duration of the first time frame, and a duration of the second time frame.

8. The method of claim 1, wherein the first time frame and the second time frame each comprises a duration of 50 ms.

9. The method of claim 1, wherein the first average magnitude, the second average magnitude, the third average magnitude, and the fourth average magnitude are root mean square averages.

10. At least one non-transitory computer readable medium configured to store one or more instructions that when executed by at least one system performs the method of claim 1.

11. A computer-implemented method to reduce noise in a signal, the method comprising:

obtaining an audio signal;

separating the audio signal into frequency components in each of a plurality of frequency bands;

obtaining a first threshold for a first frequency band of the plurality of frequency bands;

obtaining a second threshold for the first frequency band;

calculating a first envelope of first frequency components in the first frequency band during a first time frame;

calculating a second envelope of the first frequency components during a second time frame that is after the first time frame;

calculating a first signal-to-noise ratio based on a difference between a magnitude of the first envelope and a magnitude of the second envelope;

in response to the first signal-to-noise ratio being greater than the first threshold and less than the second threshold, attenuating the first frequency components by an amount based on interpolation of the first signal-to-noise ratio between the first threshold and the second threshold; and combining the frequency components, including the attenuated first frequency components, to produce an output audio signal.

12. The method of claim 11, wherein each of the plurality of frequency bands includes an approximately equal bandwidth of frequency.

13. The method of claim 11, further comprising:

obtaining a third threshold for a second frequency band of the plurality of frequency bands, the third threshold being different from the first threshold;

obtaining a fourth threshold for the second frequency band, the fourth threshold being different from the third threshold;

calculating a third envelope of second frequency components in the second frequency band during the first time frame;

calculating a fourth envelope of the second frequency components during the second time frame;

calculating a second signal-to-noise ratio based on a difference between a magnitude of the third envelope and a magnitude of the fourth envelope; and in response to the second signal-to-noise ratio being greater than the third threshold and less than the fourth threshold, attenuating the second frequency components by an amount based on interpolation of the second signal-to-noise ratio between the third threshold and the fourth threshold, wherein combining the frequency components includes combining the frequency components, including the attenuated first frequency components and the attenuated second frequency components.

14. The method of claim 11, further comprising:

calculating a fifth envelope of the first frequency components in the first frequency band during a third time frame after the first time frame and the second time frame;

calculating a sixth envelope of the first frequency components in the first frequency band during a fourth time frame that is after the third time frame;

calculating a third signal-to-noise ratio based on a difference between a magnitude of the fifth envelope and a magnitude of the sixth envelope;

in response to the third signal-to-noise ratio being less than the first threshold, attenuating the first frequency components by a fixed percentage amount; and combining the frequency components, including the attenuated first frequency components, to produce a second output audio signal during the third time frame.

15. The method of claim 11, wherein the first envelope comprises a first average magnitude of the first frequency components during the first time frame and the second envelope comprises a second average magnitude of the first frequency components during the second time frame.

16. At least one non-transitory computer readable medium configured to store one or more instructions that when executed by at least one system performs the method of claim 11.

17. A computer-implemented method to reduce noise in a signal, the method comprising:

obtaining an audio signal that includes speech;

separating the audio signal into frequency components in each of a plurality of frequency bands;

obtaining a first noise threshold that is based on one or more characteristics of human speech in a first frequency band of the plurality of frequency bands;

obtaining a second noise threshold that is based on one or more characteristics of human speech in a second frequency band of the plurality of frequency bands, the second noise threshold being different than the first noise threshold;

calculating a first signal envelope for first frequency components in the first frequency band and a second signal envelope for second frequency components in the second frequency band for a first duration of time;

calculating a third signal envelope for the first frequency components and a fourth signal envelope for the second frequency components for a second duration of time that is longer than the first duration of time and overlaps the first duration of time;

calculating a first noise ratio for the first frequency components using the first signal envelope and the third signal envelope;

calculating a second noise ratio for the second frequency components using the second signal envelope and the fourth signal envelope;

in response to the first noise ratio being less than the first noise threshold, attenuating the first frequency components by an amount based on interpolation of the first noise ratio between the first noise threshold and a third noise threshold;

in response to the second noise ratio being less than the second noise threshold, attenuating the second frequency components; and combining the plurality of frequency bands, including the attenuated first frequency components and the attenuated second frequency components, to produce an output audio signal.

18. The method of claim 17, wherein the one or more characteristics of human speech in the first frequency band include one or more phonemes of human speech in the first frequency band.

* * * * *